US012029289B1

(12) United States Patent
Quan et al.

(10) Patent No.: US 12,029,289 B1
(45) Date of Patent: Jul. 9, 2024

(54) METAL SLIDE WALLET AND METHOD OF MANUFACTURING AND USING THE SAME

(71) Applicant: Hung Trong Quan, Thai Nguyen (VN)

(72) Inventors: Hung Trong Quan, Thai Nguyen (VN); Hung Thanh Vu, Hai Phong (VN); Tu Ngoc Dang, Ha Noi (VN)

(73) Assignee: Hung Trong Quan, Thai Nguyen (VN)

( * ) Notice: Subject to any disclaimer, the term of this patent is extended or adjusted under 35 U.S.C. 154(b) by 0 days.

(21) Appl. No.: 18/454,802

(22) Filed: Aug. 24, 2023

(51) Int. Cl.
*A45C 1/06* (2006.01)

(52) U.S. Cl.
CPC ..... *A45C 1/06* (2013.01); *A45C 2001/065* (2013.01); *A45C 2001/067* (2013.01)

(58) Field of Classification Search
CPC ..... A45C 1/06; A45C 2001/065; A45C 2001/067
See application file for complete search history.

(56) References Cited

U.S. PATENT DOCUMENTS

| | | | | |
|---|---|---|---|---|
| 1,997,043 | A * | 4/1935 | Clark | A24F 15/18 206/265 |
| 9,545,141 | B2 * | 1/2017 | Hsieh | A45C 13/00 |
| 10,028,558 | B1 * | 7/2018 | Dou | A45C 1/02 |
| 10,278,466 | B2 * | 5/2019 | Talarico | A45C 11/182 |
| 2005/0224149 | A1 * | 10/2005 | Tiscione | A45C 11/182 150/148 |
| 2015/0282580 | A1 * | 10/2015 | Chen | A45C 11/182 206/425 |
| 2022/0119171 | A1 * | 4/2022 | Levitz | B65D 50/045 |

* cited by examiner

*Primary Examiner* — Tri M Mai

(57) ABSTRACT

A metal slide wallet which includes a case having a hollow space inside for storing a plurality of plastic cards and paper money; a dispensing mechanism; and a slide cover, mechanically coupled to the dispensing mechanism, operative to slide in a first direction to dispense the plurality of plastic cards and to slide in a second direction perpendicular the first direction to expose the paper money.

20 Claims, 18 Drawing Sheets

1310
1320
1321
1322
1323
1324
1330
1331
1332
1333
1334
1399
X
Y
Z

METAL SLIDE WALLET AND METHOD OF MANUFACTURING AND USING THE SAME

CLAIM OF PRIORITY

This application claims priority under 35 U.S.C. § 112(d) of Application No. 1-2023-05666 filed on 24 Aug. 2023, in the Republic Socialist of Vietnam by Hung Trong Quan et al. The patent application identified above is incorporated here by reference in its entirety.

FIELD OF THE INVENTION

The present invention relates generally to the field of personal appliances such as wallets. More specifically, the present invention relates to metal slide wallets.

BACKGROUND ART

Wallets have a long history dated back to the beginning of time. At first, pouches were created to carry personal belongings such as leftover foods, weapons such as daggers and spears, and utensils such as brimstones to make fires. As civilization advances, coin purses were invented to carry gold pieces for exchanging and buying foods. When paper currency was invented, many fold leather wallets were invented to carry paper money. Nowadays, the methods of payments and exchanges are mostly credit cards and plastic personal identification cards. Credit cards have a magnetic strip encoding personal account number of a user. Often, to the user inconveniences, the credit cards are accidentally erased because the magnetic strip is inadvertently deleted by the ubiquitous strong electromagnetic fields. These EM signals are RFID signals emitted at the automatic entrance gates at the airports, schools, offices, markets, libraries, etc. To solve this problem, RFID protective wallets have been invented to protect the integrity of the credit cards. It can be seen from the brief history above that the form and function of wallets have been changed in accordance with the advance of technology and civilization.

Furthermore, a wallet owner usually has a plurality of plastic cards such as credit cards from different banks, the identification card, the driver license, department store cards, etc. Therefore, wallets have been modified again to dispense a particular credit card, driver license, ID card, gas card, or store card once at a time with a different mechanism built inside the wallet.

The U.S. Pat. No. 9,339,094, entitled "Credit Card Holder and Wallet" by Tucker-Skow, discloses a credit card holder and wallet designed to dispense a particular credit card using a tab. More particularly, the Tucker-Skow's credit card holder is enclosed inside the wallet which includes at least one internal slot having opposed front and rear plate set apart at a distance equal to the thickness of the credit card. It also has fixed opposed side guides having credit card side guide surfaces set at a distance from each other of approximately the width of a credit card. A credit card push slide is positioned along an internal width of the slot for engaging the top of a credit card, the slide having opposed credit card slide guide surfaces in alignment with the guide surfaces of the fixed side guides. The slot and the push slide have stop surfaces which cooperate to prevent the slide from completely pushing the card out of the slot. However, this prior-art credit card wallet is complicated to manufacture because it has many parts and details. Besides the prior-art wallet is silent regarding a function to handle paper currency which is still in use and carried by many wallet owners.

Other wallet prior-arts are discussed below.

Another U.S. Pat. No. 3,648,832 entitled, "Card Carrying Case" by Kirshenbarum, describes a credit card holder for multiple cards in which the holder remains open and cannot close if a card has been removed and not replaced. A billfold or money clip is also disclosed which is secured to an outer surface of the card holder. However, the billfold is only attached to the outer surface of the card holder box. This prior-art credit card holder does not include means to protect and dispense the paper money. In addition, the holder portion is complicated to manufacture.

Yet another U.S. patent publication No. US 2013/0276943, entitled, "Low Profile Wallet" by Minn, describes a wallet formed of metal or carbon fiber plates with a surrounding elastic strap. Personal items such as paper money, credit cards, etc. can be held by the strap against the outside of one of the exterior plates. This prior-art wallet comprises a first plate, a second plate, and a substantially flat strap configured to attach around the first plate and the second plate. Different types, colors, patterns, styles, etc. of plates may be interchanged creating multiple different wallet plate combinations. The plates may include openings formed on opposite sides for retaining the strap. The shape of the openings may enable easier attachment and removal of the strap and in one example also may enable a reduction of the overall size of the plates. Separation notches may be formed on elongated upper or lower ends of the plates. The separation notches may have a substantially concave shape and/or may be offset from lateral sides of the plates. However, this prior-art wallet does not teach mechanism to expose the paper money and credit cards.

Therefore, what is needed is a wallet that is easy to operate.

What is needed is a wallet that integrate separate mechanisms to dispense different credit cards and paper money.

What is needed is a wallet that is easy to manufacture and comprised of simple components.

What is needed is a wallet that can protect credit cards and ID cards from strong scanning electromagnetic signals.

What is needed is a wallet that is long-lasting and sturdy.

What is needed is a wallet that is protective of both credit cards and paper money.

The metal slide wallet of the present invention solves all the above described problems of the prior-art wallets and meet the above needs of the consumers.

SUMMARY OF THE INVENTION

The present invention has been made in view of the aforementioned circumstances, and therefore, an object of the present invention is to provide a novel laboratory grinder designed to prevent cross contamination among samples.

An object of the present invention is to provide a metal slide wallet which includes a case having a hollow space inside for storing a plurality of plastic cards and paper money; a dispensing mechanism; and a slide cover, mechanically coupled to the dispensing mechanism, operative to slide in a first direction to dispense the plurality of plastic cards and to slide in a second direction perpendicular the first direction to expose the paper money.

Another object of the present invention is to provide a method of manufacturing a wallet that includes (a) providing a cuboid case having an internal hollow space for storing credit cards and paper money; (b) providing a dispensing mechanism; and (c) providing a slide cover, coupled to the dispensing means, capable of sliding in a first direction to dispense the credit cards and in a second direction perpendicular to the first direction to present the paper money.

Yet another object of the present invention is to provide a method of carrying and protecting credit cards and paper money, comprising (a) providing a metal slide wallet which includes a cuboid case having an internal hollow space for storing credit cards and paper money, a dispensing means, and a slide cover plate—coupled to the dispensing means—capable of sliding in a first direction, a second direction, and a third direction; (b) sliding the slide cover in the first direction to unlock the dispensing means; (c) sliding the slide cover plate in the second direction to expose the credit cards; and (d) sliding the slide cover plate in the third direction to expose the paper money.

Another object of the present invention is to provide a metal slide wallet that is easy to operate.

Another object of the present invention is to provide a metal slide wallet that is simple to manufacture.

Yet another object of the present invention is to provide a metal slide wallet that can protect both credit cards and paper money from the environment.

Another object of the present invention is to provide a metal slide wallet that can effectively shield the credit cards from the scanning electromagnetic (EM) signals.

The above objectives are achieved by providing a method of manufacturing a metal slide wallet which comprises: (a) providing a metal case that has anti radio frequency (RF) and near field communication (NFC) signals; (b) providing means for hiding and presenting credit cards; and (c) providing means for hiding and exposing paper money.

These and other advantages of the present invention will no doubt become obvious to those of ordinary skill in the art after having read the following detailed description of the preferred embodiments, which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
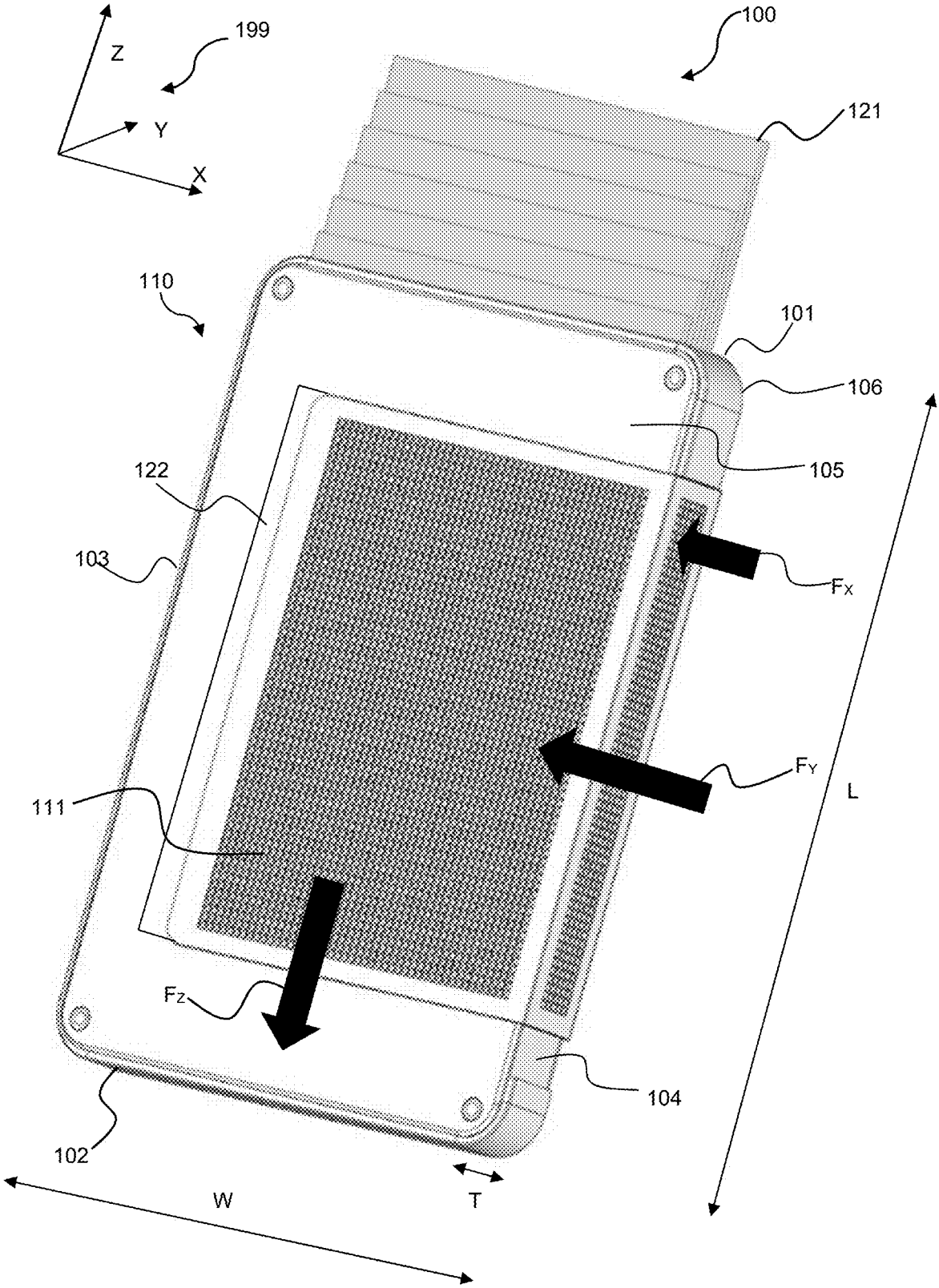
FIG. 1 is a 3D diagram illustrating a novel metal slide wallet and its operations in accordance with an exemplary embodiment of the present invention.

Now referring to FIG. 1, a 3D perspective diagram of a metal slide wallet 100 (also known as the Calibur™ wallet) in accordance with an exemplary embodiment of the present invention is illustrated. Metal slide wallet 100 has a shape of a flat and open cuboid (rectangular prism or polyhydron with a hollow space in the middle) with a predetermined length L, width W, and thickness T. In many embodiments of the present inventions, the predetermined length L, width W, and thickness T are those of standard wallet size that can fit into a pocket. The predetermined lengths L can be either 102 mm along theZ-axis of a Cartesian coordinate system 199. The predetermined width W is 68 mm along the Y-axis, and the predetermined thickness T is either 11 mm along the X-axis. In some embodiments of the present invention, metal slide wallet 100 includes main case 110, a slide cover (plate) 111, a multiple credit cards 121, and a paper money area 122 underneath slide cover plate 111. In other embodiments of the present invention, multiple credit cards 121 may be a multiple credit card holder 121 including a plurality of pockets for storing the credit cards.

Continuing with FIG. 1, main case 110 constitutes an inner hollow space to store multiple credit cards and a dispensing mechanism. The dispensing mechanism exposes either the credit cards or paper money depending on how slide cover plate 111 is operated. In other words, the dispensing mechanism is conveniently actuated by slide cover plate 111. Geometrically, main case 110 has a top side 101, a bottom side 102, a left side 103, and a right side 104. A top surface 105 and a bottom surface 106 are separated by the inner hollow space. In many embodiments of the present invention, multiple credit card holder 121 is ejected out of top side 101. In some embodiments of the present invention, paper money area 122 is a shallow tray formed on top surface 105 and underneath slide cover plate 111. In operation, a user smoothly and continuously scooches slide cover plate 111 in three different directions $F_X$, $F_Y$, and $F_Z$ to use credit cards and/or paper money. In one aspect of the present invention, the user first puts a thumb on slide cover 111 and presses in the X-axis with a force $F_X$ to loosen the dispensing mechanism and then slide down along the Z-axis and toward bottom side 102 with a force $F_Z$ to eject multiple credit cards 121 out of top side 101. To retrieve paper money, the thumb presses against lateral side 104 of slide cover plate 111 with a force $F_X$ along the X-axis to loosen and then pushes up with a force $F_Y$ along the Y axis. In another aspect of the present invention, the user may simply scrooch slide cover plate 111 with a force $F_Z$ in the Z-direction to eject credit cards 121. Yet, in another aspect of the present invention, the user may simply operate $F_Y$ to obtain the paper money. Then he/she may exert $F_X$ to loosen the dispensing mechanism and finally slide down along $F_Z$ to eject credit cards 121. In other words, slide cover plate 111 can be independently operated in three different directions $F_X$, $F_Y$, and $F_Z$ in any order and in any combinations thereof.

It is noted that $F_Z$ is orthogonal to $F_X$ which is orthogonal to $F_Y$. Other directions of forces to eject respective multiple credit cards 121 and expose paper money area 122 are within the scope of the present invention. Furthermore, the orientation and geometry of metal slide wallet 100 are not necessarily in accordance with Cartesian coordinate system 199. Metal slide wallet 100 can be and operated in other Cartesian coordinate systems that are rotated 360° at any degree around Cartesian coordinate system 199.

From the overview description of metal slide wallet 100 in FIG. 1, the following objectives of the present invention are achieved:

(1) easy to operate: slide cover plate is smoothly and continuously slid in three easy sliding movements;
(2) protective of both paper money and credit cards against the elements;
(3) shielding off RFID, NFC, and other electromagnetic signals; and
(4) slide cover plate 111 can be independently operated in with forces $F_X$, $F_Y$, and $F_Z$ three respective different directions X, Y and Z in any order and in any combinations thereof. In addition, slide cover plate 111 automatically returns to its initial position.

The structure, components, assembly, and function of metal slide wallet 100 are now described in detail in FIG. 2 to FIG. 12 below.

Figure 2:
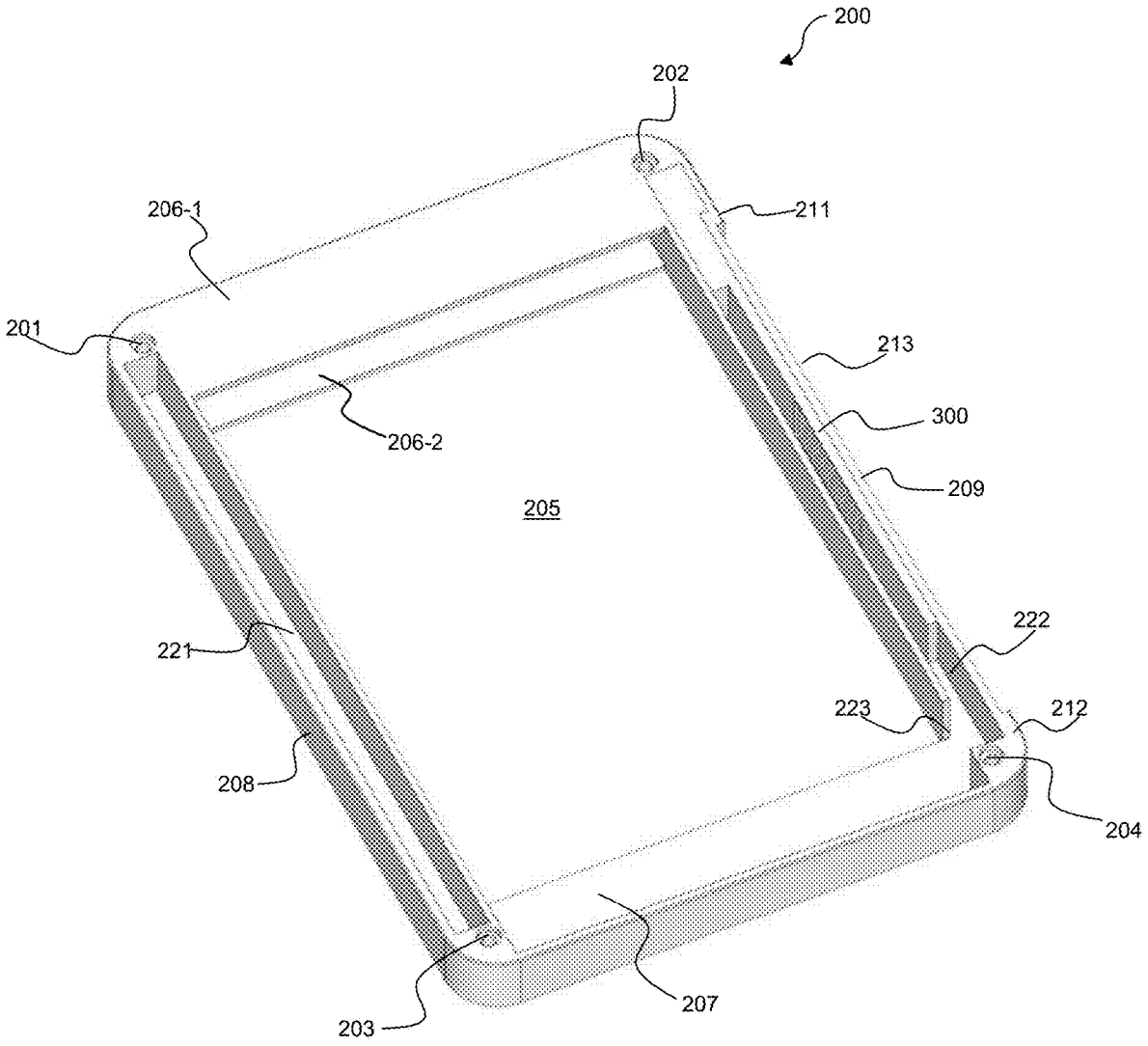
FIG. 2 is a 3D diagram illustrating the wallet frame of the metal slide wallet in accordance with an exemplary embodiment of the present invention.

Next referring to FIG. 2, a 3D perspective diagram of a wallet frame 200 in accordance with an exemplary embodiment of the present invention is illustrated. Wallet frame 200 is hollow with a top cephalic (head) border 206-1 parallel to a bottom cephalic border 206-2. A single caudal (feet) border 207 is formed on the same plane with bottom cephalic border 206-2. A central opening (hollow space) 205 is formed for storing multiple credit cards 121 and a dispensing mechanism. The dispensing mechanism is designed to dispense both credit cards and to expose paper money. Wallet frame 200 is a flat and open cuboid (rectangular prism or polyhydron with an opening in the middle) with top cephalic border 206-1, bottom cephalic border 206-2, caudal border 207, a left side 208, a right side 209, and central opening 205. Central opening 205 contains multiple credit cards or credit card holder 121. Four screw holes 201-204 are formed at the four corners of framing member 200. On left side 208, a left slide slot 221 is formed. On right side 209, a right slide slot 222 is formed. At the bottom and inside wall of right slide slot 222 there is a lever window 223 dedicated to store the first dispensing mechanism of multiple credit card holder 121. On top (cephalic) of right side 209 of main frame 200, a top stopper edge 211 is formed. Similarly, on bottom (caudal) of right side 209, a bottom stopper edge 212 is formed. Consequently, a lateral ditch 213 is etched out between top stopper edge 211 and bottom stopper edge 213. The functions of top stopper 211, bottom stopper 212, and lateral ditch 213 will be disclosed later. It is noted that, FIG. 1 to FIG. 17 disclose the metal slide wallet for right-handed (north paw) users. However, top stopper edge 211, bottom stopper edge 212, and lateral ditch 213 can be formed on left side slot 221 for left-hand (south paw) users. It is also noted that frame 200 is not equipped with a credit card decelerator button which will be disclosed in another embodiment in the following FIGs.

Figure 3:
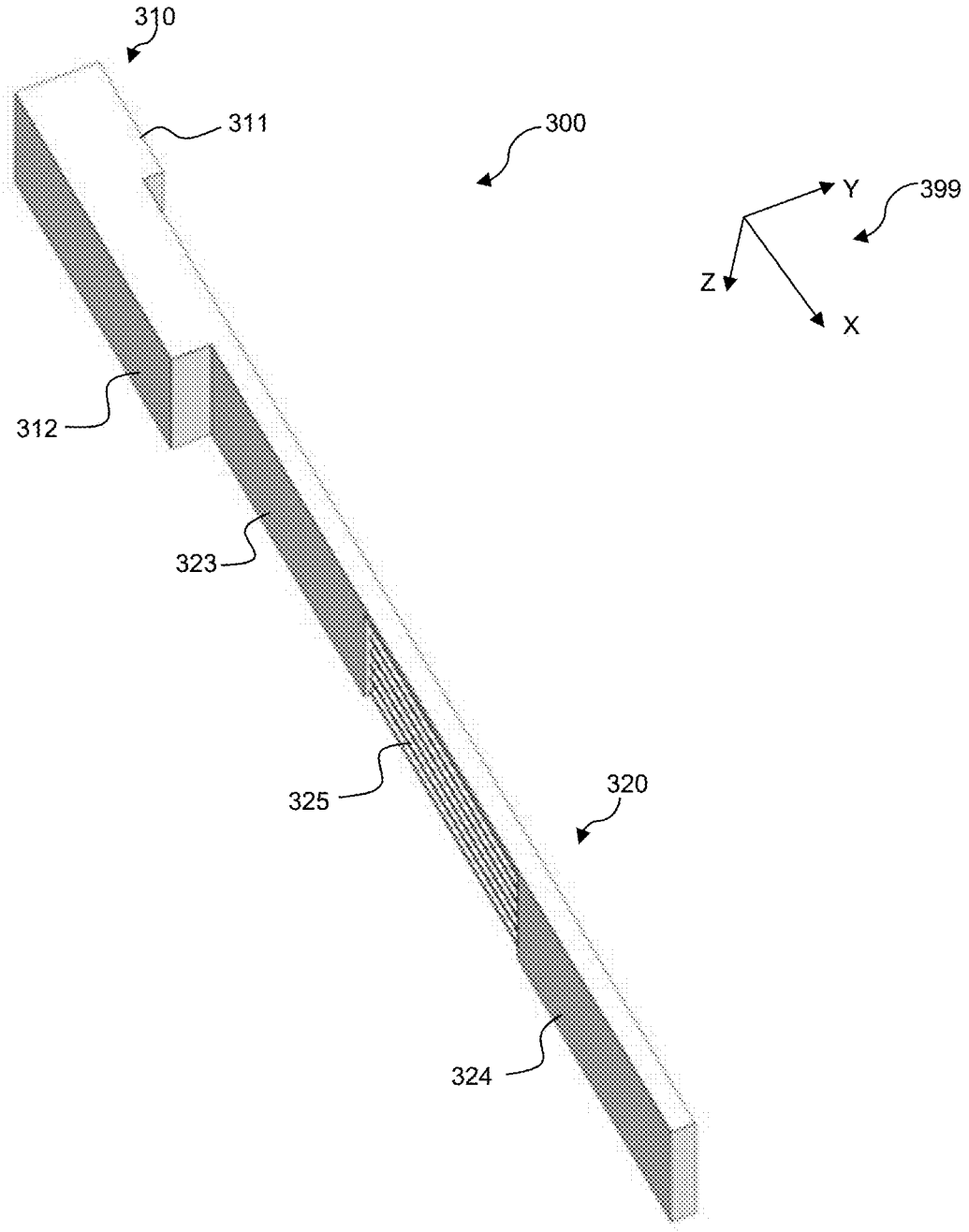
FIG. 3 is a 3D diagram of the slide controller bar in accordance with an exemplary embodiment of the present invention.

Now referring to FIG. 3, a 3D perspective diagram of slide controller bar 300 in accordance with an exemplary embodiment of the present invention is illustrated. In many embodiments of the present invention, slide controller bar 300 includes a top slide guide 310 and a bottom slide guide 320. Structurally, top slide guide 310 is further divided to a first header 311 and a second header 312. First header 311 and second header 312 are protruded out from top slide guide 310. As a result, second header 312 and first header 311 are thicker than bottom slide guide 320 in the Y-axis direction. Second header 312 is longer than first header 311 along the X-axis. Bottom slide guide 320 includes a top smooth section 323, a serrated section 325, and a bottom smooth section 324. Serrated section 325 is formed only on one side of bottom slide guide 320. The serration of serrated section 325 is formed along the Z-axis and on the same side with second header 312. The first direction (X-axis) and the second direction (Z-axis) are based on a Cartesian coordinate system 399. However, other orthogonal directions of top slide guide 310 and bottom slide guide 320 are within the scope of the present invention. In operation, second header 312 and first header 311 are designed to control or limit the sliding movement of slide cover plate 111 along the X-axis. Serrated section 325 is designed to hold slide cover plate 111 in position.

Figure 4:
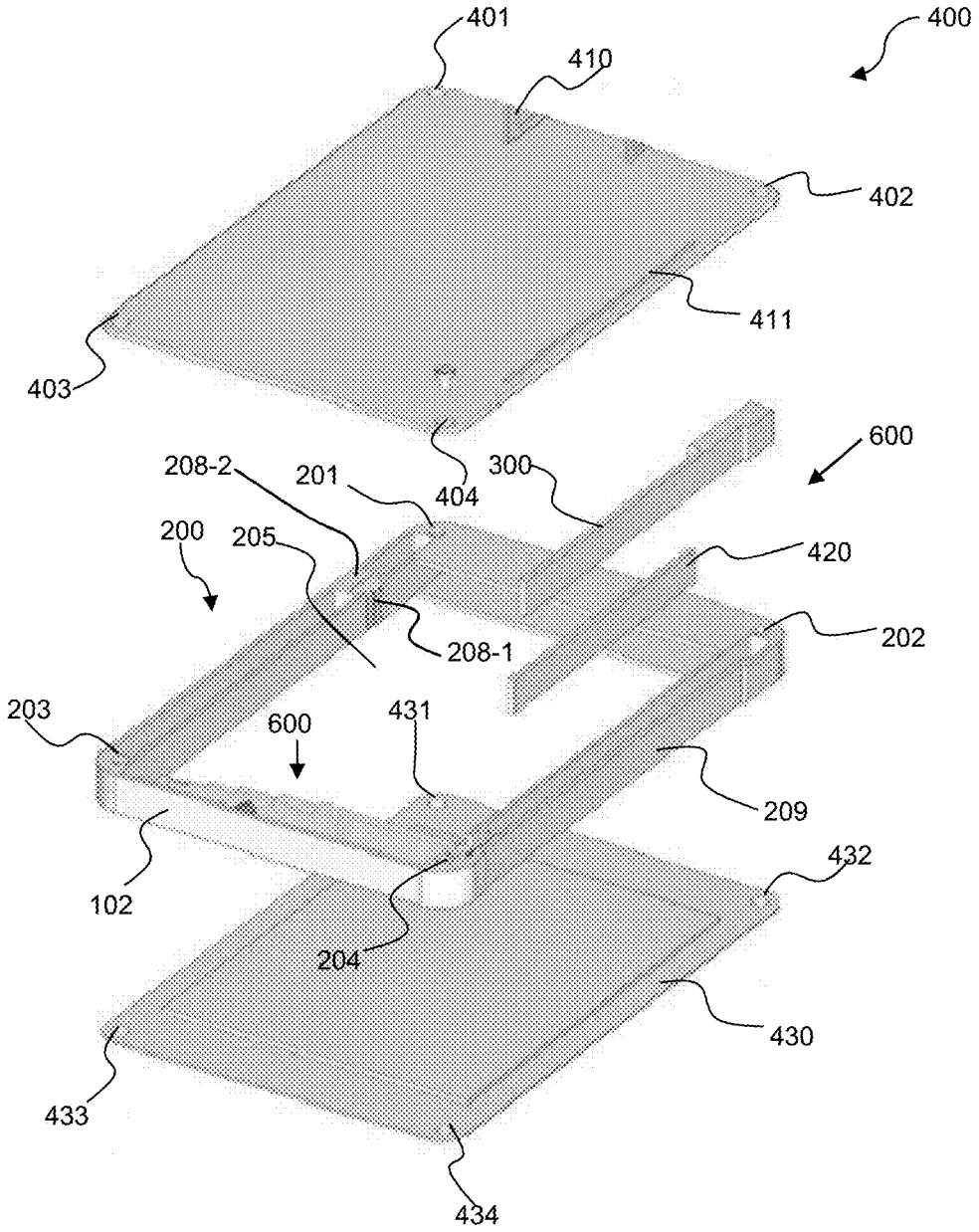
FIG. 4 is a 3D diagram showing the inner components of the main case in accordance with an exemplary embodiment of the present invention.

Next referring to FIG. 4, a 3D perspective diagram of the components of a complete main case 400 of metal slide wallet 100 in accordance with an embodiment of the present invention is illustrated. Main case 400 includes wallet frame 200, a top cover plate 410, a bottom cover plate 430, slide controller bar 300, a spacer 420, and a first dispensing mechanism 600. Wallet frame 200 includes a decelerator button 208-1 protruding out from left side 208. Decelerator button 208-1 is adjustable. That is decelerator button 208-1 can be moved in or outward from left side slot 221 which contains a decelerator housing 208-2. Decelerator housing 208-2 houses decelerator button 208-1 and includes an adjusting screw that can adjust the protrusion of decelerator button 208-1 into central opening 205. First dispensing mechanism 600 is positioned completely inside of central opening 205 along bottom side 102 while slide controller bar 300 and spacer 420 are positioned inside right slide slot 222. The detailed structure of first dispensing mechanism 600 will be described fully in FIG. 6. Specifically, top cover plate 410 is a thin metal sheet having a rectangular shape. Top cover plate 410 has four screw holes 401-404 located at its four corners and an insertion slot 411 formed on the right hand side of top cover plate 410. Bottom cover plate 430 has the same size and shape as that of top cover plate 410. Bottom cover plate 430 is completely solid and has four screw holes 431-433 located at the four corners. Screw holes 401-404, 201-204, and 431-434 are lined up so that top cover plate 410 and bottom cover plate 430 are secured to main frame member 200, forming main case 400. In many embodiments of the present invention, wallet frame 200, top cover plate 410, and bottom cover plate 430 are made of aluminum 7075 or stainless steel 316L. It is noted that aluminum 7075 has RFID and NFC blocking properties to protect the credit cards.

Figure 5:
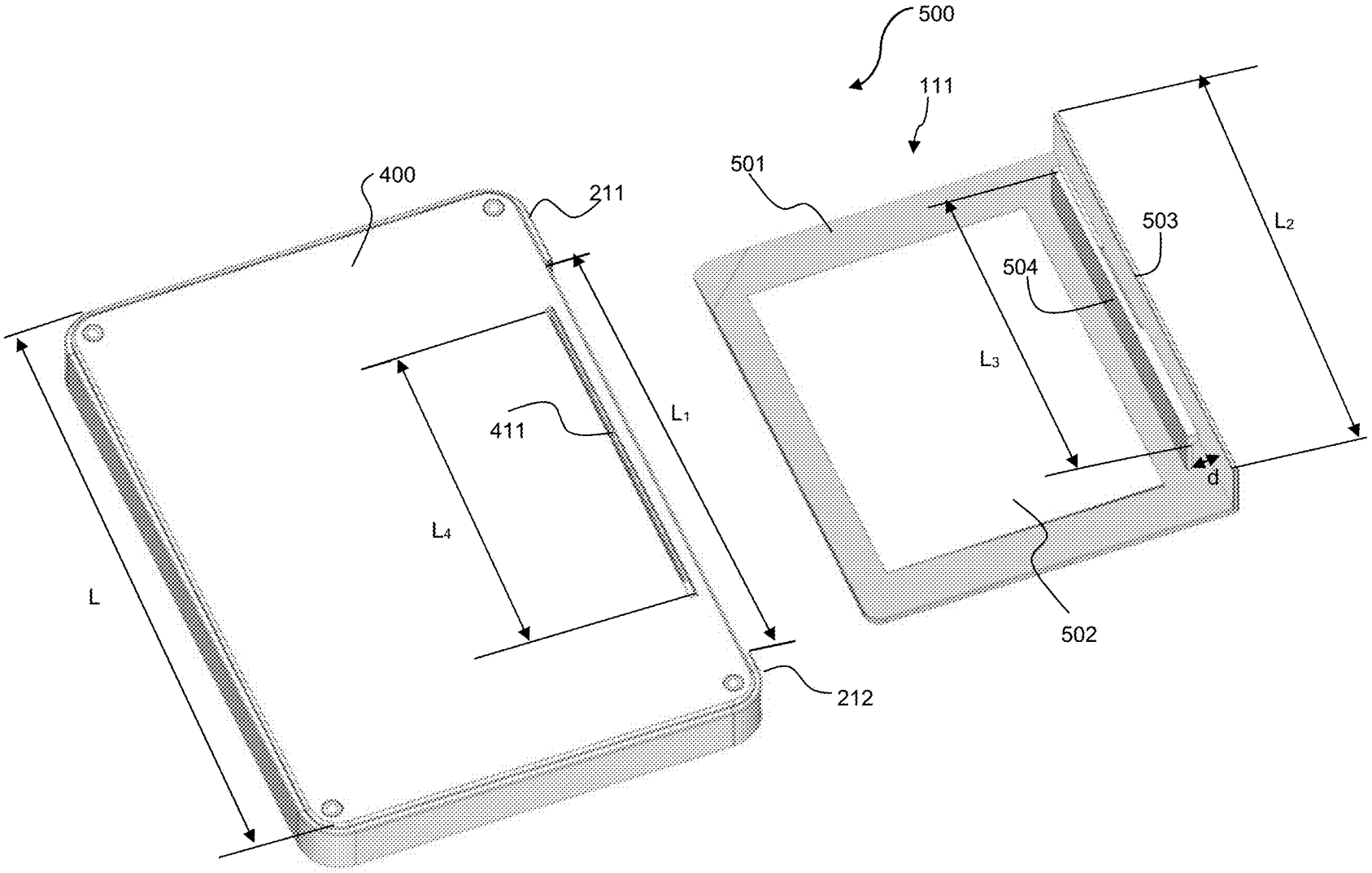
FIG. 5 illustrates the slide cover plate designed to couple to the main case in accordance with an exemplary embodiment of the present invention.

Referring next to FIG. 5, a 3D perspective diagram shows the structure of a slide cover plate 500 designed to couple to main body 400 to form metal slide wallet 100 in accordance with an exemplary embodiment of the present invention is illustrated. Slide cover plate 500 is slide cover 111 described above in FIG. 1. Structurally, slide cover plate 500 includes a top surface with a rim 501 surrounding a central surface 502. A lateral section 503 is formed perpendicular to rim 501. Parallel to lateral section 503 and located at a distance d is an insertion bar 504. The distance d is so dimensioned that Insertion bar 503 is inserted into an insertion slot 411 whereby lateral section 503 stays completely inside lateral ditch 213. Dimensionally, lateral ditch 213 has a length of $L_1$ is smaller than the length L of metal slide wallet. The length of lateral section 503 is $L_2$ which is less than $L_1$ so that lateral section 503 is moving along lateral ditch 213 and is stopped by top stopper edge 211 and bottom stopper edge 212. The length of insertion slot 411 is $L_4$. The length of insertion bar 504 is $L_3$. $L_3$ is dimensioned less than $L_4$ so that insertion bar 504 can slide smoothly along insertion slot 411. In many embodiments of the present invention, $L_1$ is 75 mm, $L_2$ is 63.7 mm, $L_3$ is 43.1 mm, and $L_4$ is 53.5 mm.

Figure 6:
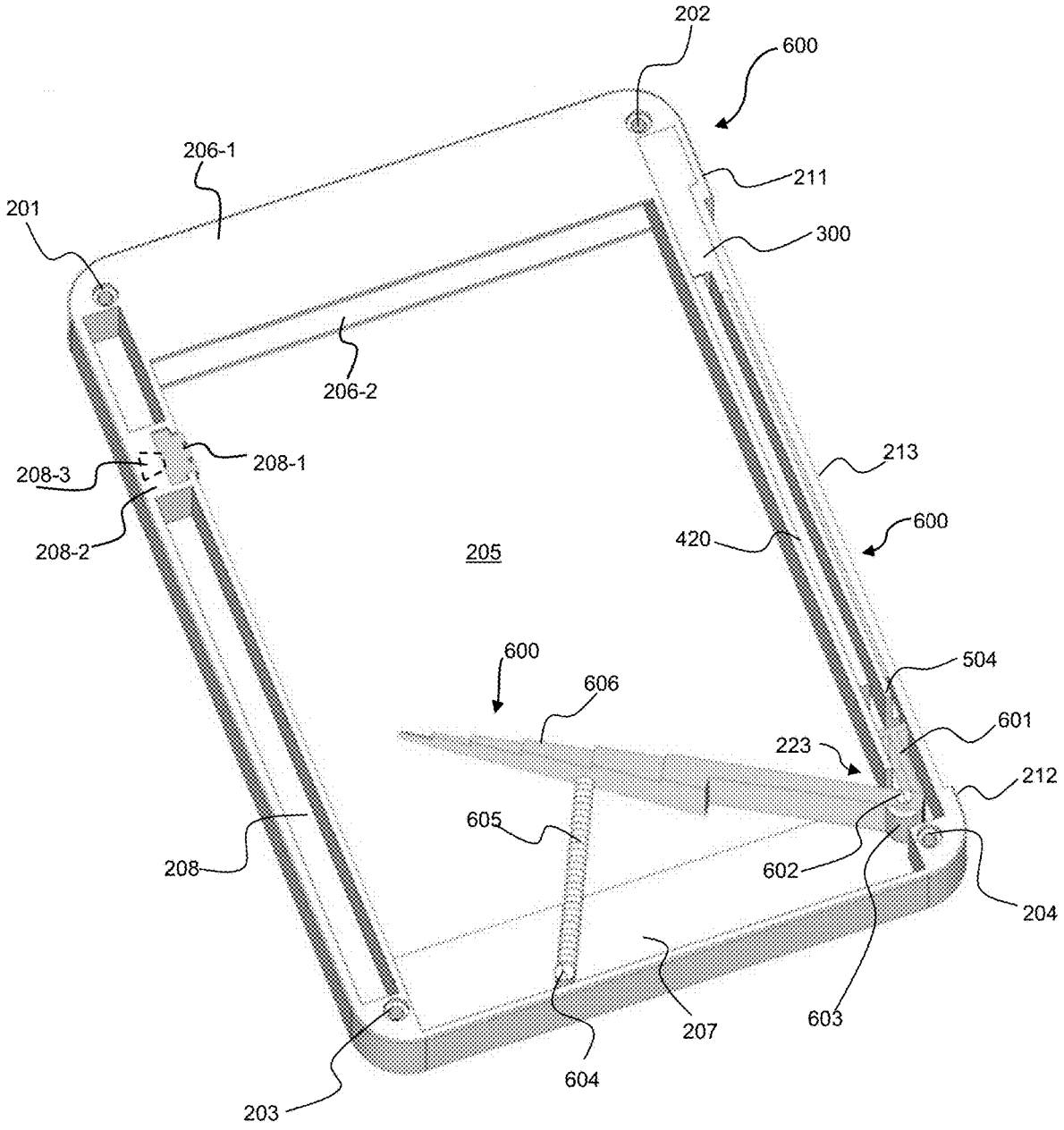
FIG. 6 is a 3D diagram illustrating structure of the first dispensing mechanism in accordance with an exemplary embodiment of the present invention.

Referring now to FIG. 6, a 3D diagram illustrating a first dispensing mechanism 600 designed to dispense the credit card holder in a predetermined direction in accordance with an exemplary embodiment of the present invention is illustrated. First dispensing mechanism 600 includes: slide controller bar 300, actuator 601, a pivot 602, a wheel 603, a spring pivot 604, a spring 605, and a lever arm 606. Next, after spacer bar 420 is placed in the space between slide controller bar 300 and insertion bar 504, actuator 601 is inserted into right slide slot 222 that contacts the feet of insertion bar 504. On the opposite side, actuator 601 is fastened to wheel 603 which is secured by a pivot 602. Wheel 603 and pivot 602 are located at lever window 223. They are rotably connected to lever arm 606. Lever arm 606 is coupled to spring 605 which is fastened to caudal border 207 by spring pivot 604. Lever arm 606 is designed to have graded steps formed on its top surface, each representing a level of multiple credit card holder 121 exit out of main case 400. An accessory component of first dispensing mechanism 600 is decelerator housing 208-1 and decelerator button 208-1 located on either left side slot 221 or right side slot depending on the preference and dexterity of the users. An adjustable screw 208-3 adjusts the degree of protrusion of decelerator button 208-1 into central opening 205. Decelerator button 208-1 is designed to slow down the ejection of the credit cards 121. The deeper the protrusion, the more deceleration in the ejection of multiple credit cards 121 results.

With the first dispensing mechanism 600 disclosed above, the following objectives of the present invention is achieved: slide cover plate 111 can be independently operated in three different directions $F_X$, $F_Y$, and $F_Z$ in any order and in any combinations thereof.

Figure 7:
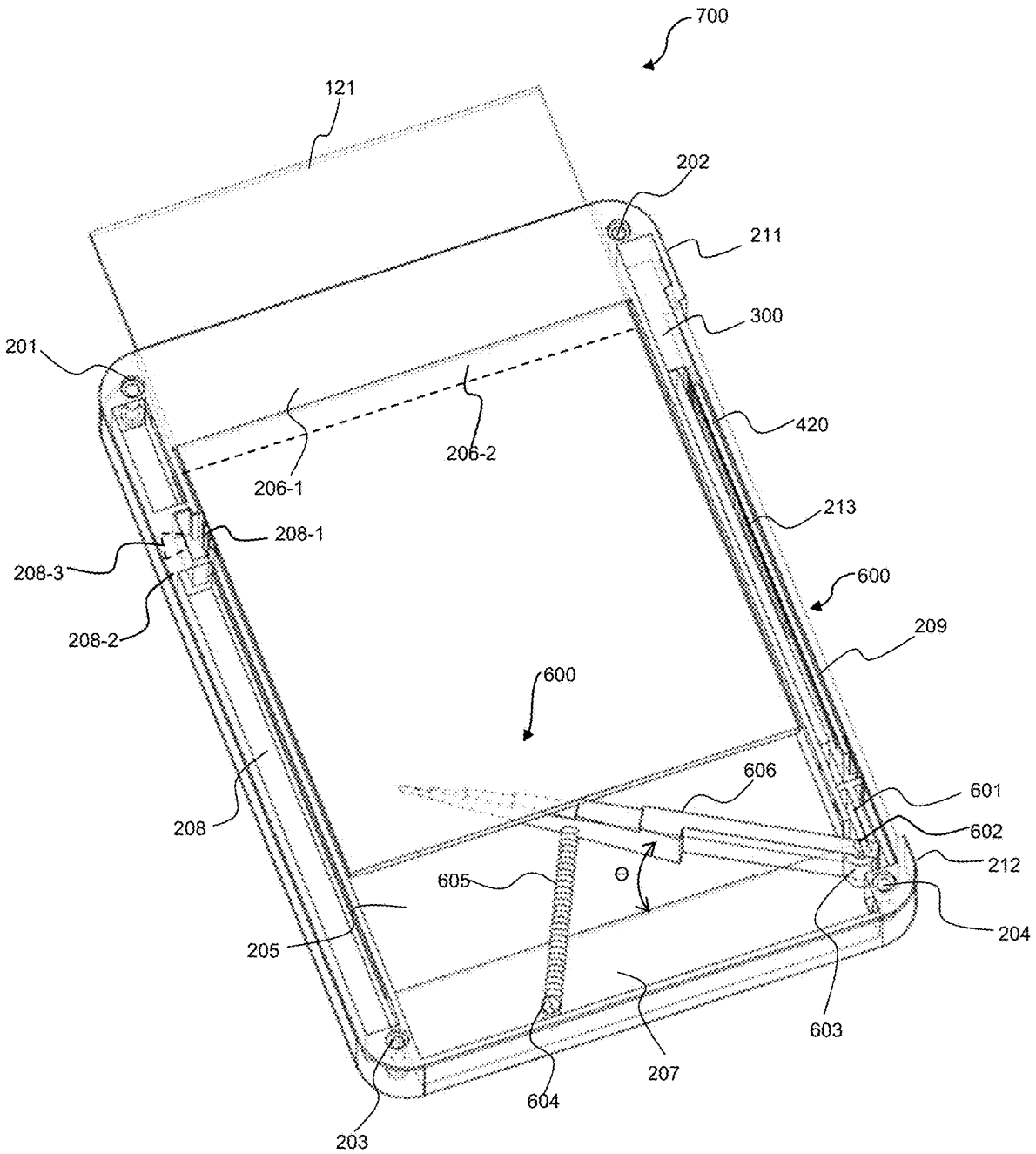
FIG. 7 is a 3D diagram illustrating the operations of the first dispensing mechanism in accordance with an exemplary embodiment of the present invention.

Turning now to FIG. 7, a 3D diagram 700 demonstrating the operation of the first dispensing mechanism of metal slide wallet that exposes multiple credit card holder 121 out of main case 400 in accordance with an exemplary embodiment of the present invention is illustrated. Multiple credit card holder 121 is inserted inside opening 205 between top cephalic border 206-1, bottom cephalic border 206-2, and caudal border 207. The bottom of multiple credit card holder 121 rests on lever arm 606. In operation, when a force $F_X$ is applied to insertion bar 504, it slides down along right slide slot 222, pushing actuator 601 down to wheel 603 which pushes lever arm 606 up to form an angle θ with caudal border 207. The larger the force Fx, the larger the angle θ. Thus, multiple credit cards 121 are pushed upward, partially exposed out of main case 110. In actuality, multiple credit cards 121 can be exposed one credit card at a time depending on the force Fx. The ejection of multiple credit cards 121 can be controlled by decelerator button 208-1. After use, the elastic coefficient k of spring 605 causes lever arm 606 to return to its original position, which is parallel to caudal border 207. Finally, the user can insert the credit cards back to metal slide wallet 100 from top side 201.

Figure 8:
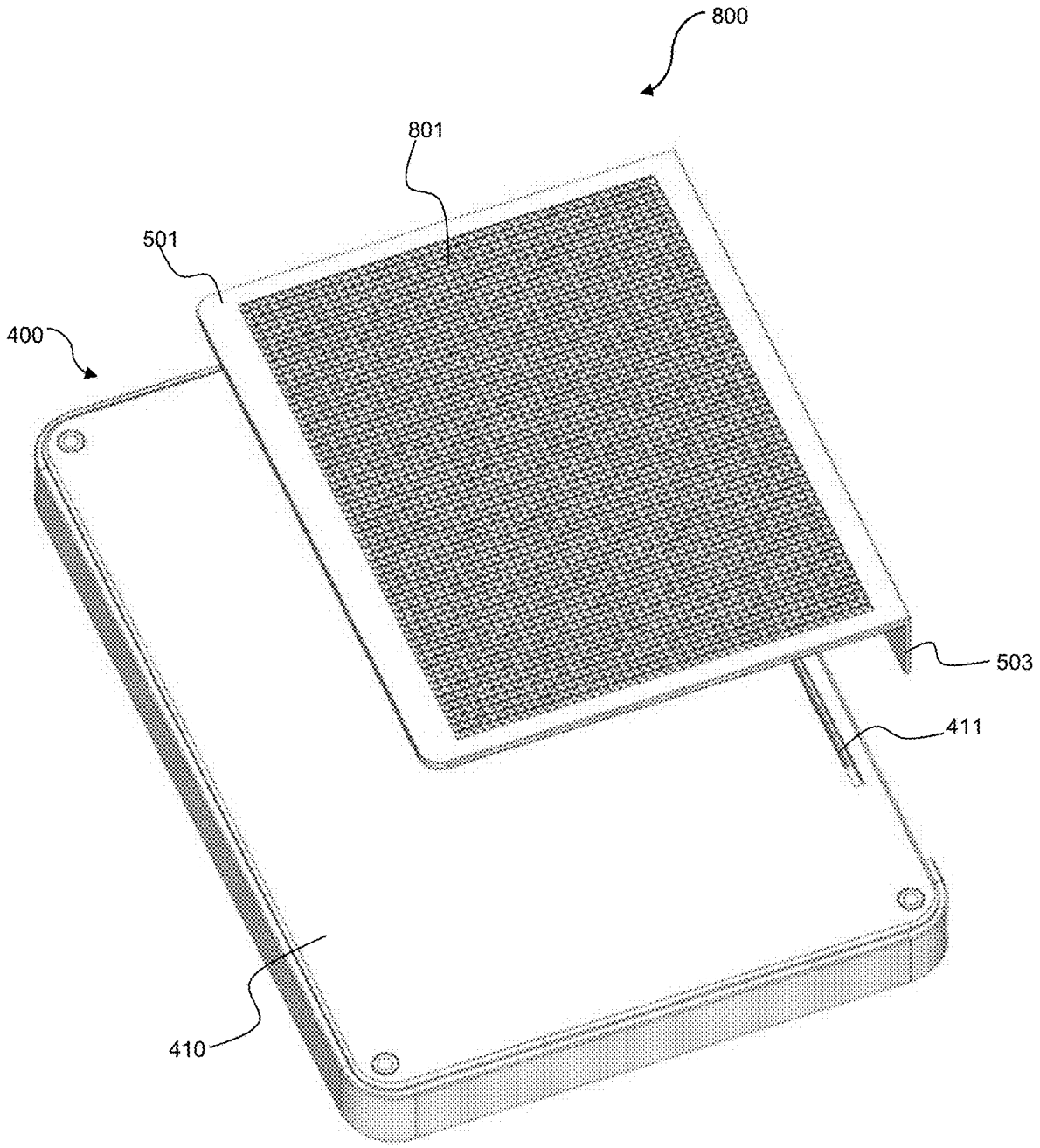
FIG. 8 is a 3D diagram illustrating coupling of the slide cover plate into the main case in accordance with an exemplary embodiment of the present invention.

Next referring to FIG. 8, a 3D diagram 800 of the manner the slide cover place is coupled to the main case to form the metal slide wallet in accordance with an exemplary embodiment of the present invention is illustrated. After top plate 410, first dispensing mechanism 600, and bottom plate 430 are assembled to wallet frame 200 to form main case 400, insertion bar 504 is inserted to insertion slot 411. That is, slide cover 501 is coupled to main case 400 using insertion bar 504 inserting into insertion slot 411. In various embodiments of the present invention, a protective sheet 801 is adhered to central section 502 of slide cover 501. Protective sheet 801 is made of thick cloth, wood, leather, plastic, or lacquer.

Figure 9:
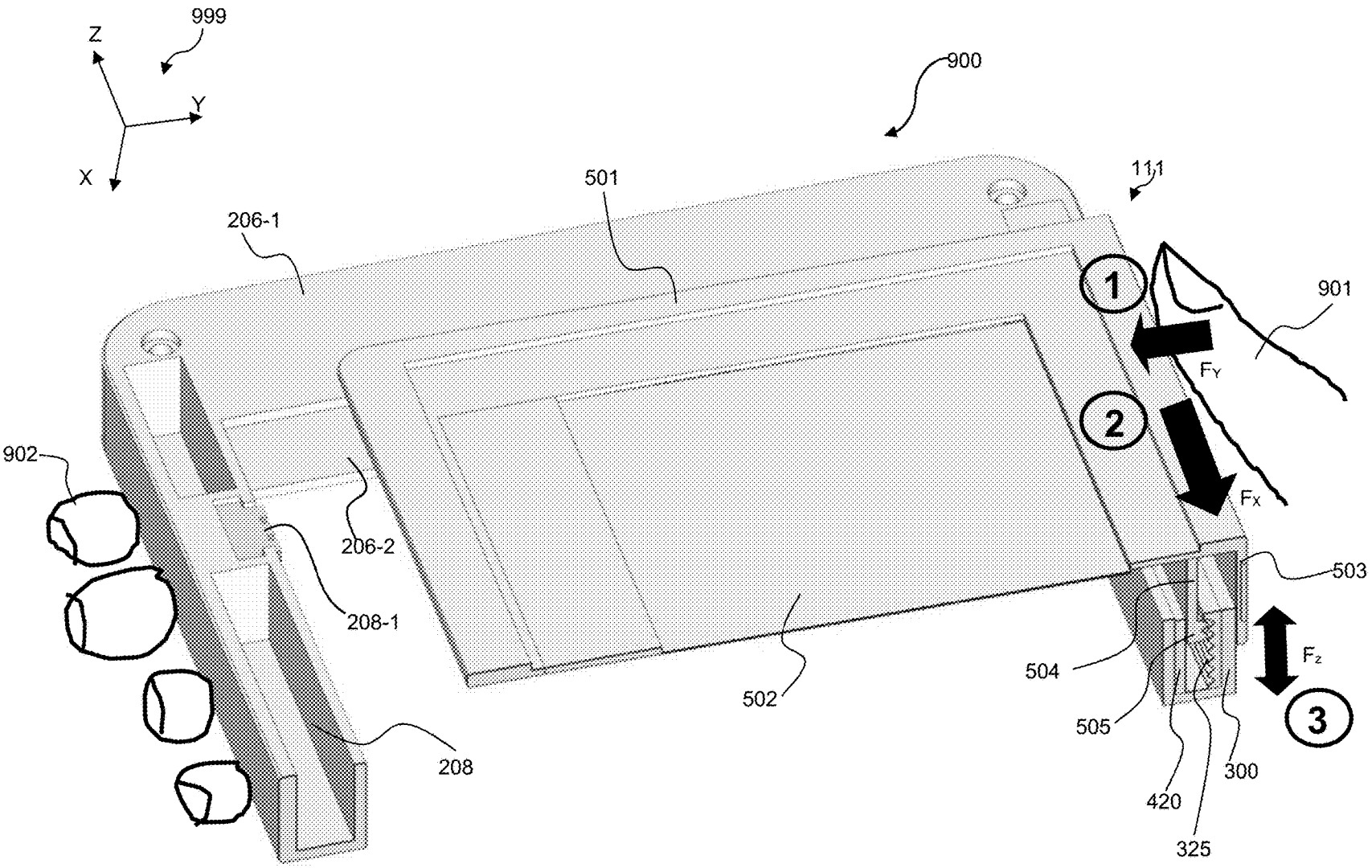
FIG. 9 illustrates the operating principle of the first dispensing mechanism used in the metal slide wallet in accordance with an exemplary embodiment of the present invention.

In FIG. 9, a 3D diagram 900 explaining the operation of the slide cover plate and the first dispensing mechanism in accordance with an exemplary embodiment of the present invention is illustrated. It is noted that metal slide wallet 100 described from FIG. 1 to FIG. 11 is designed for north paw (dexiotropic or right handed people), the same structure and operations for the southpaw (left handed people) are within the scope and obvious to the present invention. For the right hand design, metal slide wallet 100 is held in the palm of the user so that a thumb 901 touches lateral side 503 of slide cover 111 and the remaining fingers hold left side 208. In operation, metal slide wallet 100 can be operated in three different and independent movements in any order and in any combinations thereof. At step 1, thumb 901 presses against lateral side 503 of slide cover 111 with a force $F_Y$ in the Y-direction to separate serrated section 325 from those of insertion bar 504. At step 2, thumb 901 can push slide cover 111 with a force $F_Z$ in the Z-direction to expose paper money area 122. To use credit cards, at step 1, thumb 901 presses against lateral side 503 of slide cover 111 with a force $F_Y$ in the Y-direction to separate serrated section 325 from those of insertion bar 504. At step 3, thumb 901 slides down slide cover 111 in the X-direction with a force $F_X$ as described in FIG. 7 to eject multiple credit card holder 121 out of main case 110. The ejection of multiple credit cards 121 can be controlled by decelerator button 208-1. With this design, credit cards 121 can be dispensed one by one for the user's convenience: the harder the force $F_X$, the more credit cards are displayed. It is noted again that step 1, 2, or 3 can be performed smoothly and continuously and in any order and in any combinations thereof. For illustration, in another aspect of the present invention, the user may simply scrooch slide cover plate 111 with a force $F_X$ in the X-direction to eject credit cards 121. Yet, in another aspect of the present invention, the user may operate $F_Z$ first to obtain the paper money. Then he/she may exert $F_Y$ to loosen dispensing mechanism 600 and finally slide down along $F_X$ to eject credit cards 121. In other words, slide cover plate 111 can be independently operated in with forces $F_X$, $F_Y$, and $F_Z$ three respective different directions X, Y and Z in any order and in any combinations thereof. In addition, slide cover plate 111 automatically returns to its initial position due to spring 605.

Figure 10:
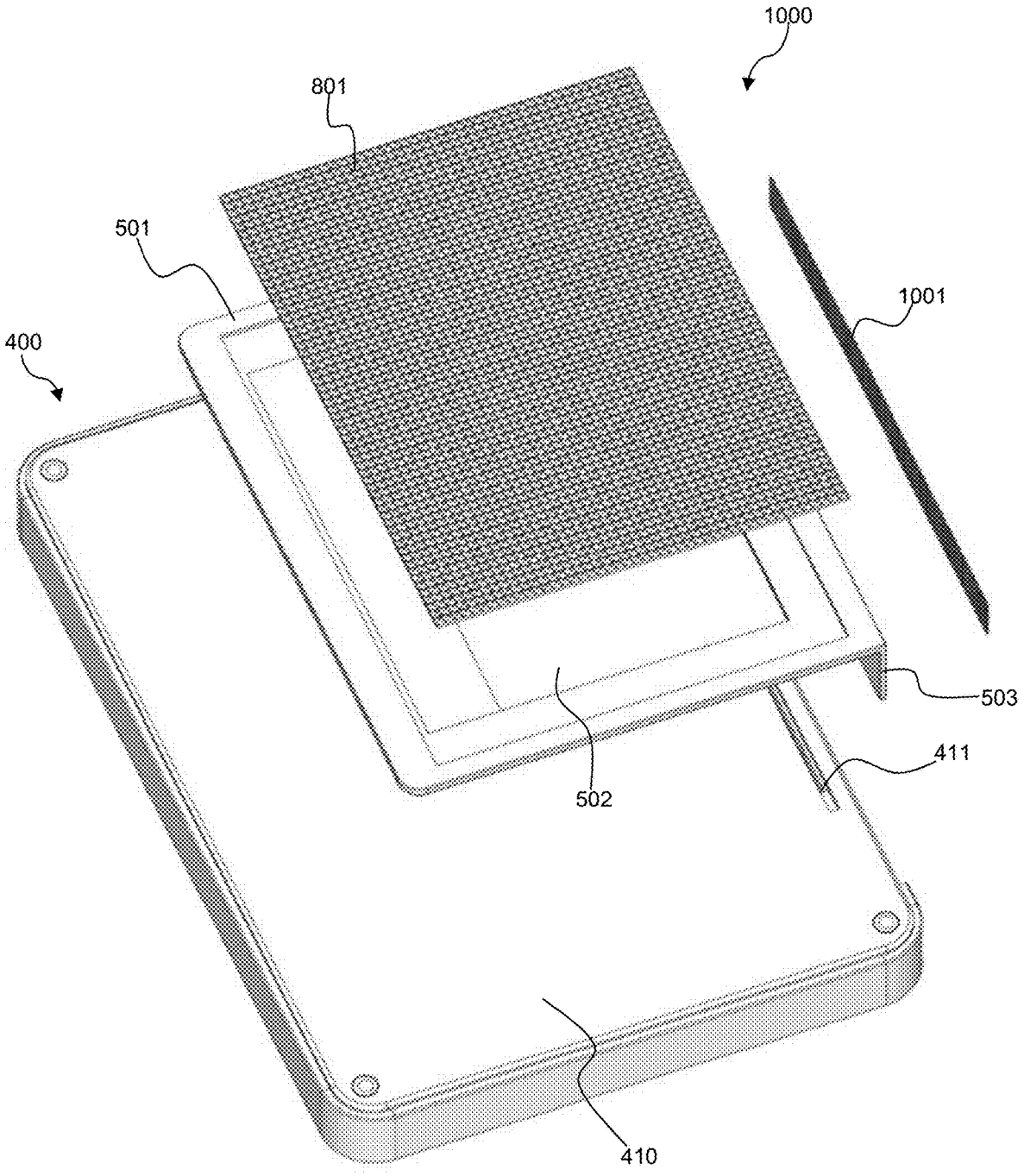
FIG. 10 is a 3D showing the protective covers of the slide cover plate in accordance with an exemplary embodiment of the present invention.

FIG. 10 illustrates a 3D diagram 1000 illustrating the manner the top protective sheet and the side protective sheet are adhered to the top plate in accordance with an exemplary embodiment of the present invention. After slide cover plate 111 is inserted into main case 400, a protective sheet 801 is adhered to central section 502 of top surface 501. A side protective sheet 1001 is adhered to lateral section 503. In many aspects of the present invention, the adhesive material for protective sheets 801 and 1001 is glue. However, other adhesive means such as laser fusion can also be used. Side protective sheet 1001 is made of wood, thick cloth, fiber, plastic, or lacquer.

Figure 11:
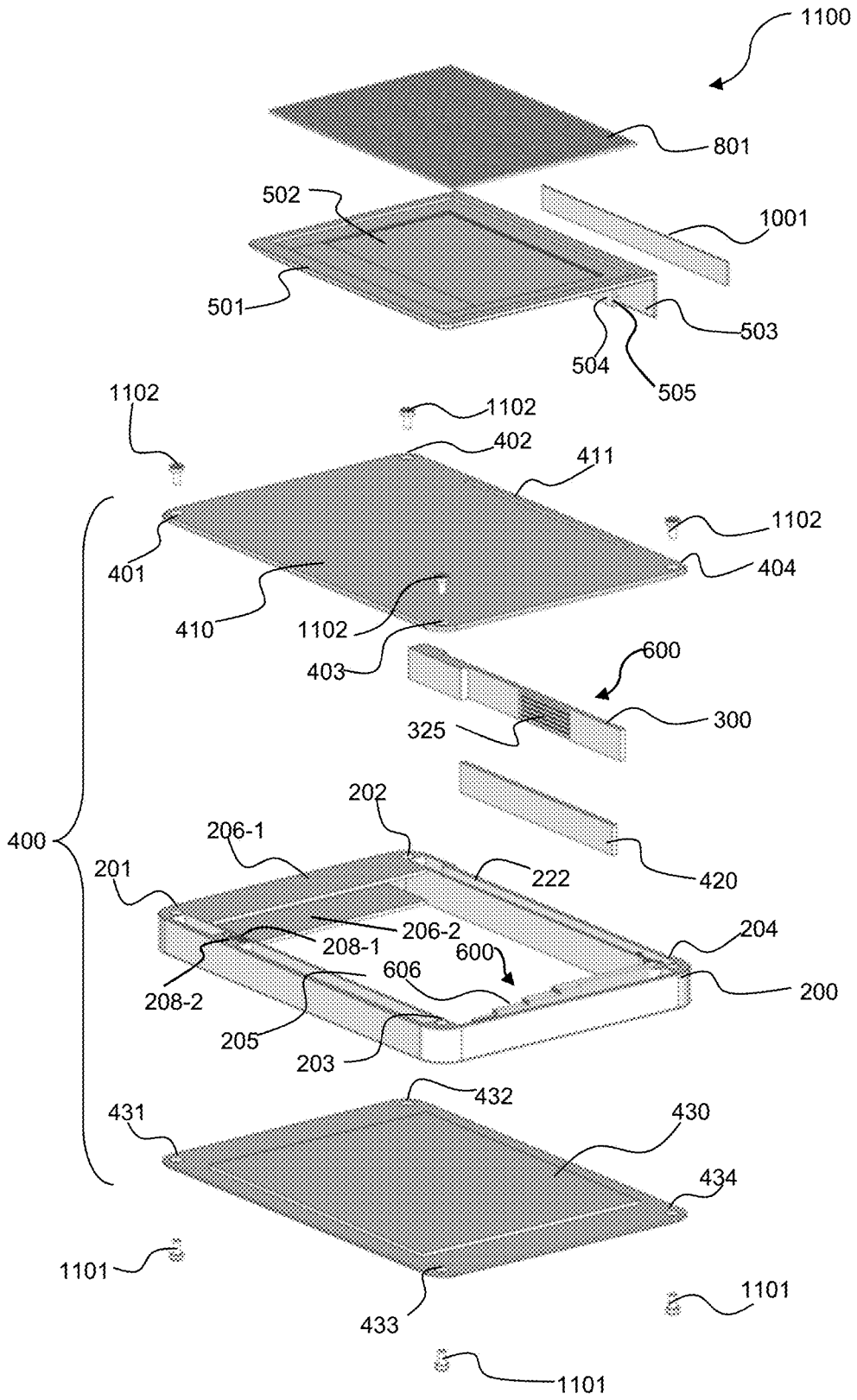
FIG. 11 is an assembly instructions of the metal slide wallet in accordance with an exemplary embodiment of the present invention.

Now referring to FIG. 11, a 3D assembly diagram 1100 showing the constituent components and assembling steps of metal slide wallet in accordance with an exemplary embodiment of the present invention is illustrated.

Referring back to FIG. 1 to FIG. 10 above, main case 400 is assembled first. As described above, main case 400 includes wallet frame 200, top cover plate 410 and bottom cover plate 430. Top cover plate 410, wallet frame 200, and bottom cover plate 430 are arranged so that screw holes 401-404, 201-204, and 431-434 are lined up. First bottom cover plate 430 is secured to main frame 200 at screw holes 431-434 by first set of screws 1101. Bottom plate 430 and central opening 205 form a space for storing multiple credit card holder 121. Slide controller bar 300 and spacer 420 are posited into right slide slot 222. Then, actuator 601 is also placed right at the foot of slide guide 300. Pivot 601, wheel 603, and lever arm 606 are connected together at lever window 223. Spring 605 is fastened to lever arm 606 and to caudal border 207 by spring pivot 604. Then top cover plate 410 is secured to main frame 220 at screw holes 201-204 using first set of screws 1101. Protective sheet 801 is adhered to slide cover 501 at central area 502. Protective sheet 1001 is adhere to lateral side 503. Insertion metal 504 is inserted to insertion slot 411. At this moment, serrated section 325 is in directly contact with serrated section 505. In many embodiments of the present invention, main case 400 is made of aluminum 7075 and stainless steel 316L.

Figure 12:
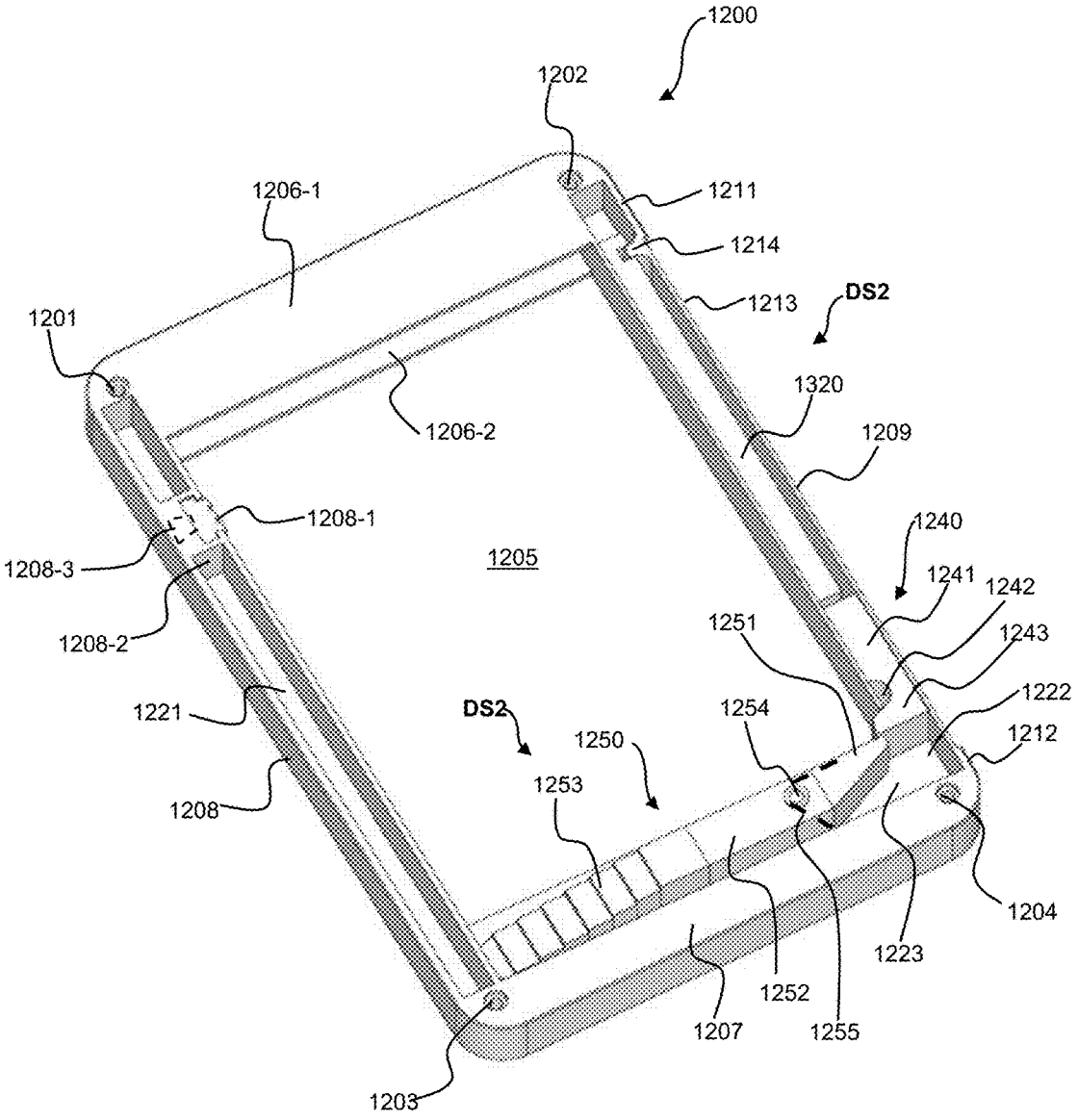
FIG. 12 is a 3D diagram shows a another embodiment of the metal slide wallet that uses a second dispending mechanism in accordance with an exemplary embodiment of the present invention.

Next referring to FIG. 12, a 3D perspective diagram of a wallet frame 1200 having a second dispensing mechanism DS2 in accordance with an exemplary embodiment of the present invention is illustrated. As described above, a framing member 1200 is hollow and comprises a top cephalic border 1206-1, a bottom cephalic border 1206-2, and a caudal border 1207 with a central opening 1205 there between. Central opening 1205 is cut out for storing multiple credit card holder 121 and second slide mechanisms DS2 to dispense both credit cards and to expose paper money. Wallet frame 1200 is a flat and open cuboid (rectangular prism or polyhydron with an opening in the middle) with top cephalic border 1206-1, bottom cephalic border 1206-2, caudal border 1207, a left side 1208, a right side 1209, and central opening 1205. Four screw holes 1201-1204 are formed at the four corners of wallet frame 1200. On left side 1208, a left slide slot 1221 is formed. On right side 1209, a right slide slot 1222 is formed. At the bottom and inside wall of right slide slot 1222 there is lever window 1223 dedicated to store the second dispensing mechanism DS2. On top (cephalic) right side 1209 of wallet frame 1200, a top stopper edge 1211 is formed. Similarly, on bottom (caudal) right side 1209, a bottom stopper edge 1212 is formed. Consequently, a lateral ditch 1213 is etched out therebetween. The functions of top stopper edge 1211, bottom stopper edge 1212, and lateral ditch 1213 are similar to those disclosed above. Second dispensing mechanism DS2 includes a slide control bar 1231 whose head portion is normally in lock with a stop spur 1214 formed next to top stopper edge 1211. The head portion of slide controller bar 1230 includes a cut (see FIG. 13) that mates with stop spur 1214. Along right slide slot 1222 and below actuator 1211, an actuator 1240 is placed. Actuator 1240 has a top portion 1241 and a foot portion 1243 separated by a groove 1242. A lever arm 1250 includes four segments: a tail segment 1251, a main body segment 1252, a graded segment 1235, and a pivot 1254. Pivot 1254 is wound by a torsion spring 1255 in such a manner that causes lever arm 1250 to behave like a clipboard that returns to its original position when force is stopped exerting on tail segment 1251. Lever arm 1250 is pivoted above bottom border 1207 by pivot 1254. Tail segment 1251 has a triangular shape with the vertex making contact with foot 1243 of actuator 1240 when actuator 1240 is pushed downward. Thus, the second dispensing mechanism of the present invention obviates the need of spring 605. Similar to first dispensing mechanism, an accessory component of second dispensing mechanism DS2 is a decelerator housing 1208-1 and a decelerator button 1208-1 located on either left side slot 221 or right side slot depending on the preference and dexterity of the users. An adjustable screw 1208-3 adjusts the degree of protrusion of decelerator button 1208-1 into central opening 205. Decelerator button 1208-1 is designed to slow down the ejection of the credit cards 121. The deeper the protrusion, the more deceleration in the ejection of multiple credit cards 121 results.

With second dispensing mechanism DS2 disclosed above, slide cover plate 111 can be independently operated in three different directions $F_X$, $F_Y$, and $F_Z$ in any order and in any combinations thereof. Slide cover plate 111 shall automatically returns to its initial position due to torsion spring 1255.

Figures 13A, 13B, 13C:
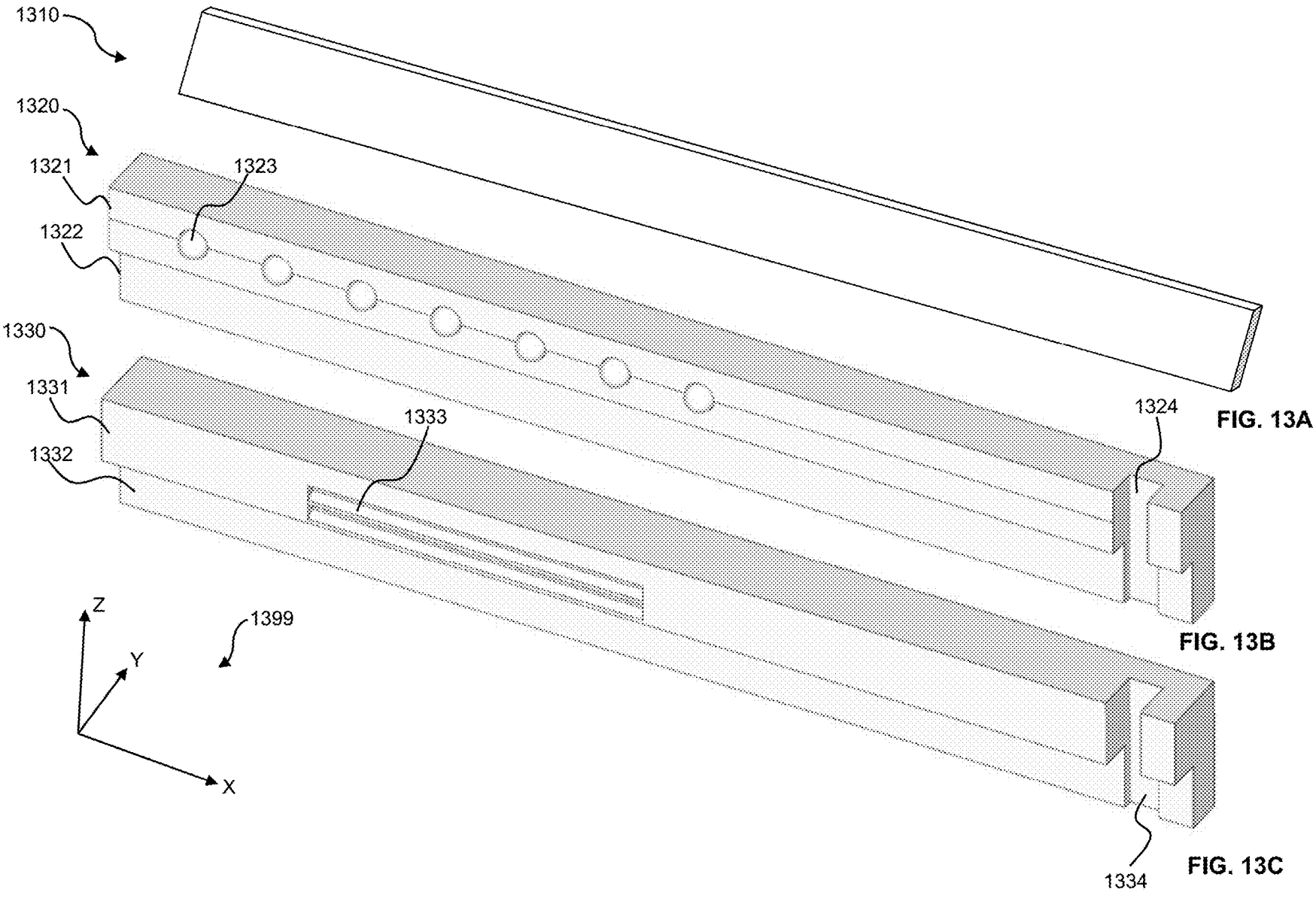
FIG. 13A, FIG. 13B, and FIG. 13C illustrate a spacer, a first embodiment of a slide controller bar and another embodiment of the slide controller bar respectively of the second dispensing mechanism in accordance with various exemplary embodiments of the present invention.

Next referring to FIG. 13A-FIG. 13C, perspective diagrams 1310, 1320, and 1330 of components stored inside right side slot that are parts of the second dispensing mechanism in accordance with various exemplary embodiments of the present invention are illustrated. In FIG. 13A, a spacer 1310 is used to effect the operation of the second dispensing mechanism. In all aspects, spacer 1310 is the same as spacer 420. In first dispensing mechanism 600, spacer 420 is required because without it the force $F_Y$ to separate the serrated section 325 and second serrated section 505 is ineffective. However, in the second dispensing mechanism, spacer 1310 is optional. Next, in FIG. 13B, a first embodiment of a slide controller bar 1320 is shown. Slide controller bar 1320 includes an upper portion 1321 which is thicker than a lower portion 1322. At the distal end of slide controller bar 1320, a groove 1324 is cut vertically along the Z-axis from upper portion 1321 to lower portion 1322. Groove 1324 mates with stop spur 1214. Along the X-axis, an array of ball lock pins 1323 is disposed in upper portion 1321. See Cartesian coordinate system 1399 for reference. Next, in FIG. 13C, a second embodiment of a slide controller bar 1330 is shown. Slide controller bar 1330 includes a top portion 1331 which is thicker than a bottom portion 1332. At the distal end of slide controller bar 1330, a groove 1334 is cut vertically along the Z-axis from upper portion 1331 to lower portion 1332. Groove 1334 mates with stop spur 1214. Along the X-axis, an array of serrated section 1333 is disposed in upper portion 1331. The operations of first slide controller bar 1320 and second slide controller bar 1320 will be made clear later.

Figure 14:
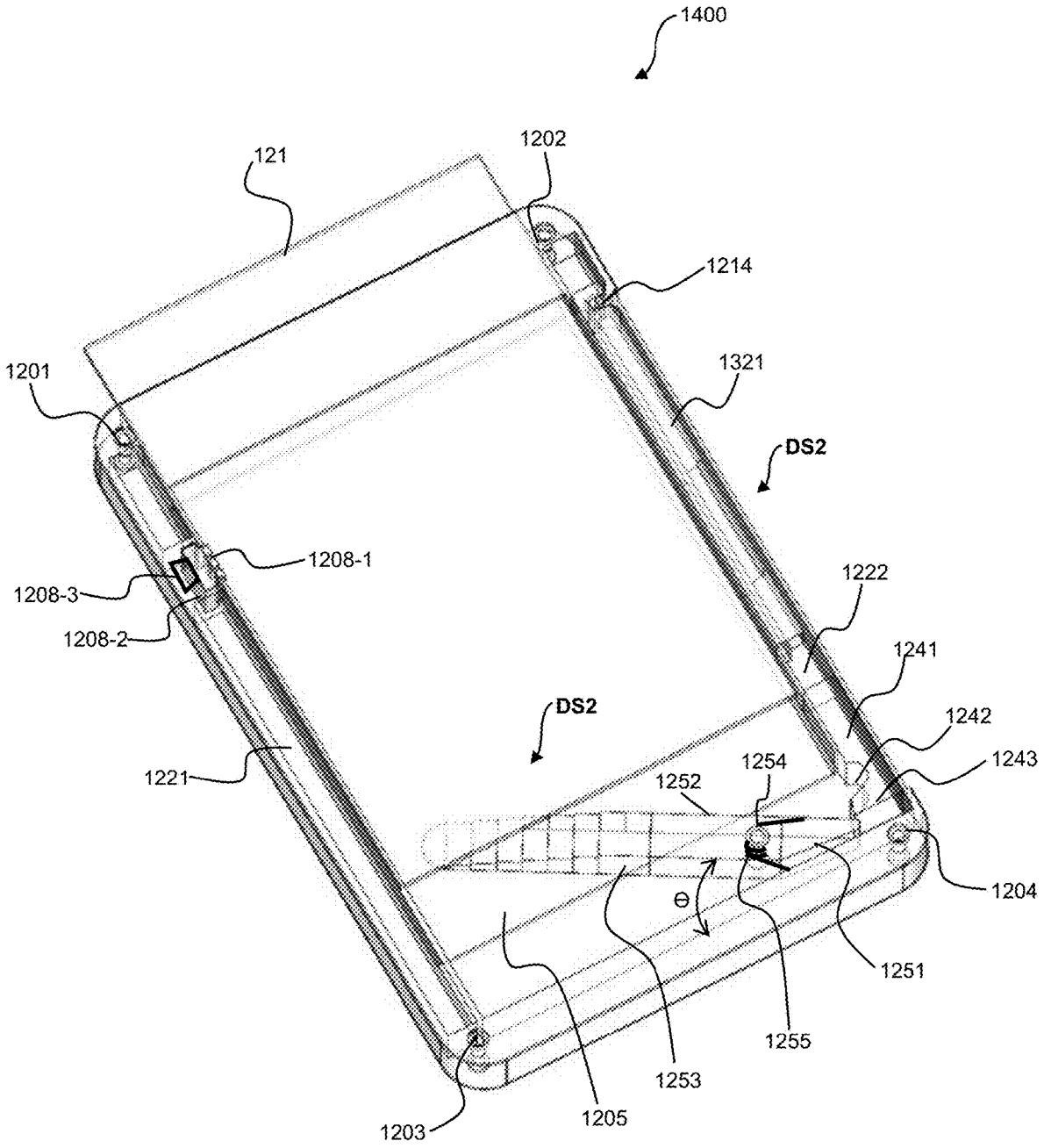
FIG. 14 illustrates the components of the main case and the second dispensing mechanism of the metal slide wallet in accordance with an exemplary embodiment of the present invention

Referring now to FIG. 14, a cross-section diagram of a main case 1400 in accordance with an exemplary embodiment of the present invention is illustrated. Next, after spacer bar 1310 is placed in the space between slide controller bar 1320 and insertion bar 504, actuator 1240 is inserted into right slide slot 1222 that contacts the feet of slide controller bar 1320. On the opposite side, actuator 1240 is designed to contact tail segment 1251. Tail segment 1251 and foot 1243 are positioned at lever opening 1223. Lever arm 1250 is coupled to framing member 1200 which is secured to bottom border 1207 by pivot 1254. Lever arm 1250 is designed to have graded segment 1253 formed on its top surface, each representing a level of multiple credit card holder 121 exit out of main case 1400. Pivot 1254 is wound by torsion spring 1255 in a manner that lever arm 1250 behaves like a clipboard or clothespin. When foot 1243 releases its pressure on tail segment 1251, torsion spring 1255 causes lever arm 1250 to return to its initial position.

Figure 15:
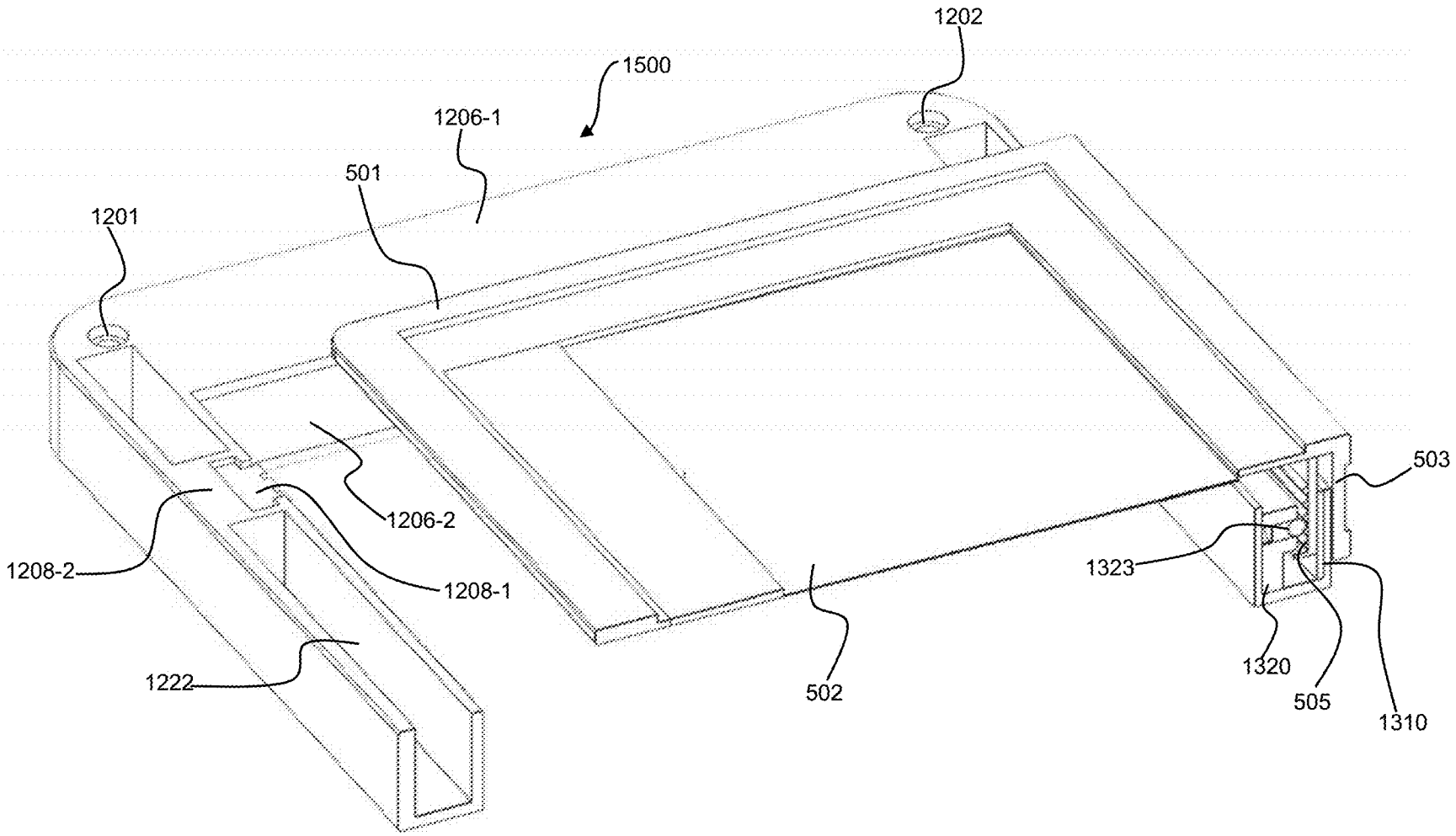
FIG. 15 illustrates the interoperability between the second dispensing mechanism and the slide cover plate of the metal slide wallet in accordance with an exemplary embodiment of the present invention

In FIG. 15, a 3D cross-section diagram 1500 illustrating the operation of the slide cover in accordance with an exemplary embodiment of the present invention is illustrated. It is noted that metal slide wallet 100 described from FIG. 1 to FIG. 17 is designed for north paw (dexiotropic or right handed people), the same structure and operations for the southpaw (left handed people) are within the scope and obvious to the present invention. After assembly, slide controller bar 1320 with array of ball lock pins 1323 is engaged with serrated section 325 of slide cover 1502. Spacer 1310 effectuates the movement of array of ball lock pins 1323 against serrated section 505. Second dispensing mechanism DS2 provides smoother feels to the operation of metal slide wallet 100. If right side slot 1222 is designed with sufficient space for slide controller bar 1320 and serrated section 325, then spacer 1310 is obviated.

Figure 16:
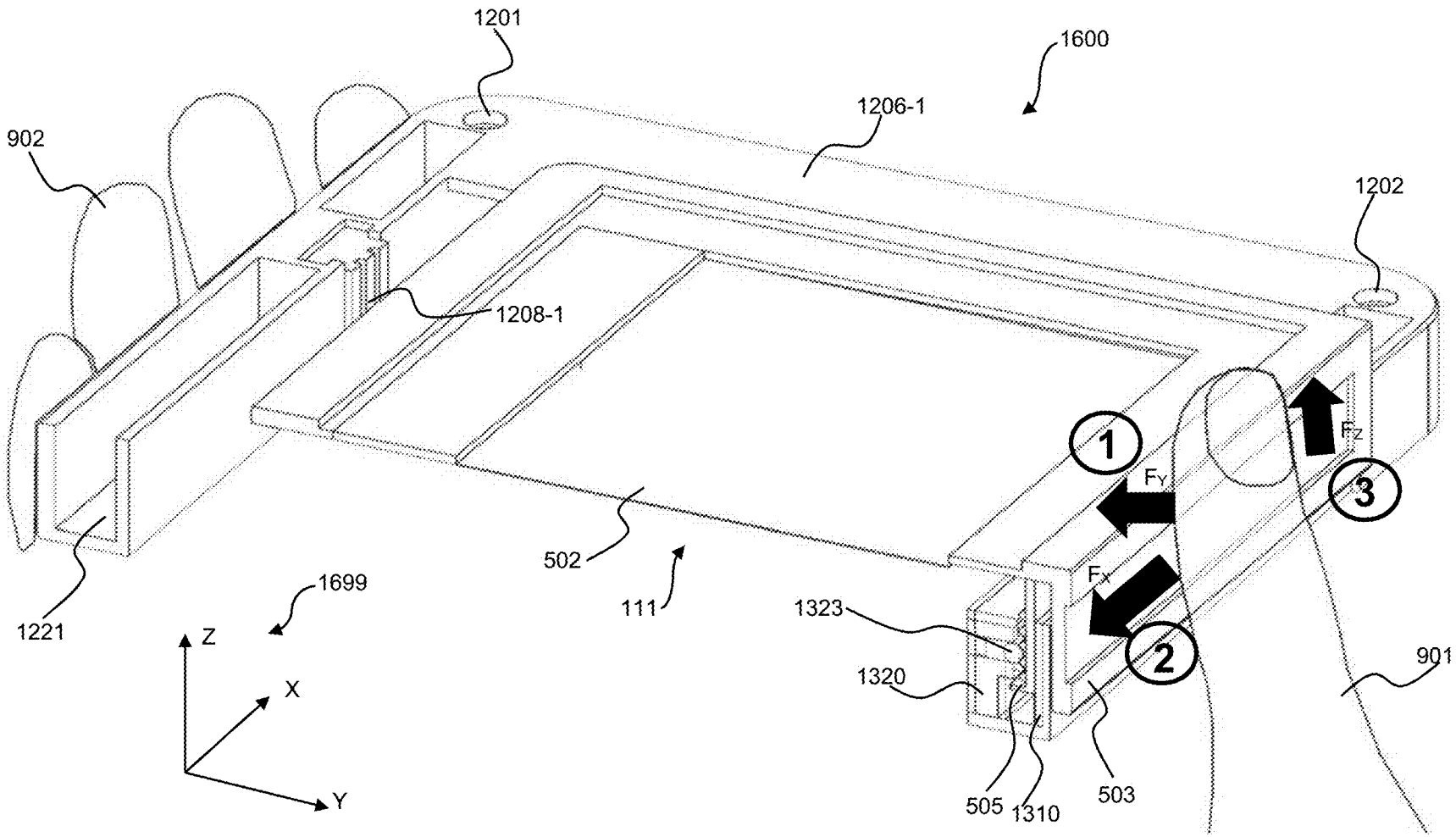
FIG. 16 illustrates the operations of the second dispensing mechanism of the metal slide wallet in accordance with an exemplary embodiment of the present invention

In FIG. 16, a 3D cross-section diagram 1600 explaining the operation of the slide cover using the second dispensing mechanism in accordance with an exemplary embodiment of the present invention is illustrated. For the right hand design, metal slide wallet 100 is held in the palm of the user so that a thumb 901 touches lateral side 503 of slide cover 111 and the remaining fingers touch left side 208. In operation, metal slide wallet 100 can be operated in three different and independent movements in any order and in any combinations thereof. At step 1, thumb 901 presses against lateral side 503 of slide cover 111 with a force $F_Y$ in the Y-direction to engage serrated section 505 to array of ball lock pins 1323. During engagement, array of ball lock pins 1323 is pushed in the Y-direction. At step 2, thumb 901 slides down slide cover 111 in the X-direction with a force $F_X$ to eject multiple credit cards 121 out of main case 1210. Decelerator button 1208-1 controls the ejection of credit cards 121. After use, lever arm 1250 automatically returns to its initial position just like a clothespin due to torsion spring 1255. When this happens, foot 1243 is pushed upward, which, in turn, pushing upper portion 1321 upward to its original position at stop spur 1214. At step 3, thumb 901 push slide cover 111 with a force $F_Z$ in the Z-direction to expose the paper money area 121. For illustration, in another exemplary aspect of the present invention, the user may simply scrooch slide cover plate 111 with a force $F_X$ in the X-direction to eject credit cards 121. Yet, in another aspect of the present invention, the user may simply operate step 3 with a force $F_Z$ first to obtain the paper money. Then he/she may exert the force $F_Y$ to loosen second dispensing mechanism DS2 and finally slide down along $F_X$ to eject credit cards 121. In other words, in various preferred embodiment of the present invention, slide cover plate 111 can be independently operated with forces $F_X$, $F_Y$, and $F_Z$ three respective different directions X, Y and Z in any order and in any combinations thereof.

From the operations of metal slide wallet 100 of the present invention as described in FIG. 1, FIG. 9, and FIG. 16, from anywhere on slide cover 111, a user perform a few simple continuous and smooth operations to use metal slide wallet 100. First, pressing in to loosen, then slide down along the side to expose the credit cards, and then pushing up in the direction perpendicular to the face of metal slide wallet 100 to expose the cash money. These operations can be performed smoothly and continuously. That is, step 1, step 2, and step 3 are independent to one another and the users can perform these steps in any order and any combinations thereof.

Figure 17:
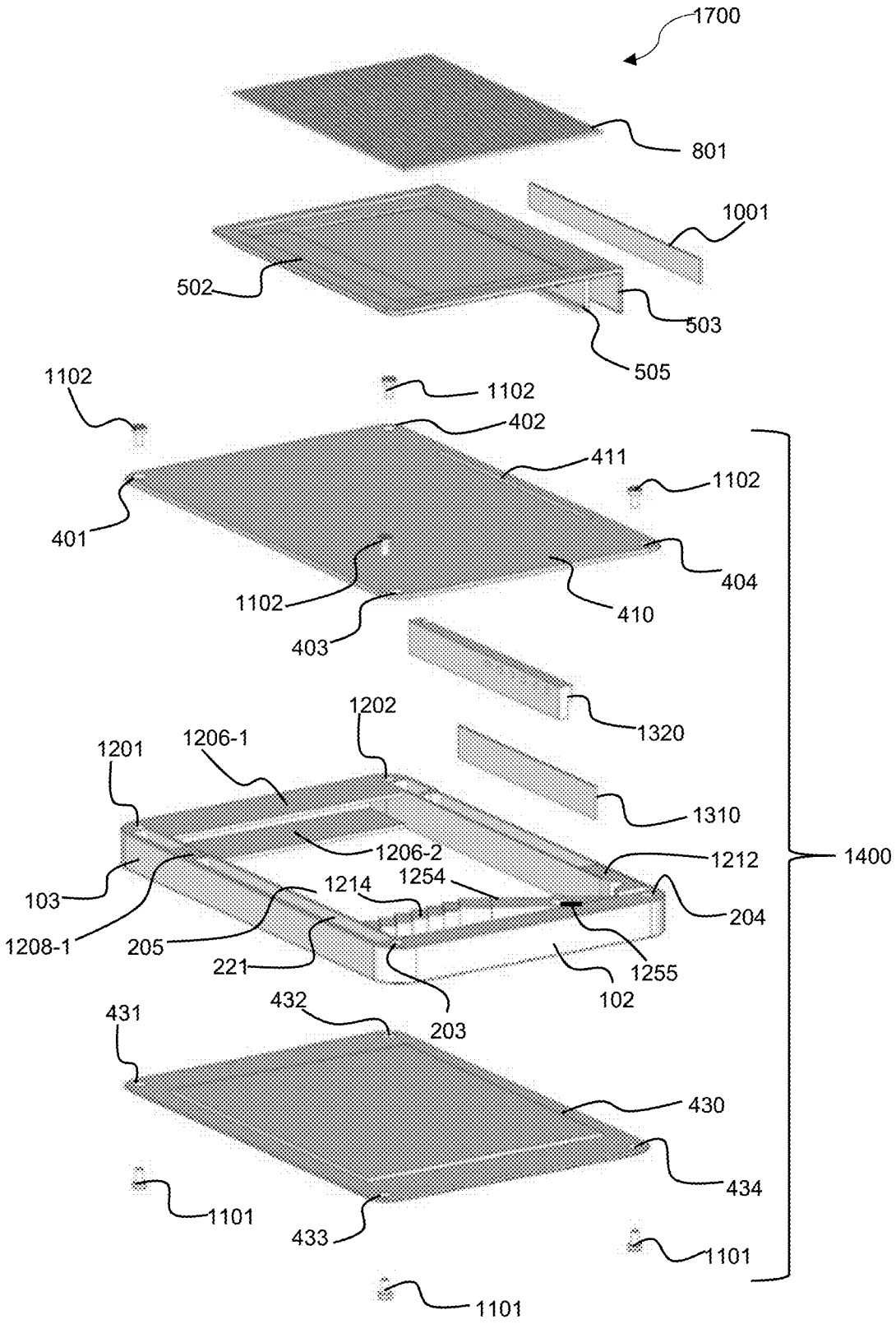
FIG. 17 is an assembly steps of the metal slide wallet equipped with the second dispensing mechanism in accordance with an exemplary embodiment of the present invention.

Now referring to FIG. 17, a 3D assembly diagram 1700 showing the components and assembling steps of metal slide wallet in accordance with an exemplary embodiment of the present invention is illustrated.

Referring back to FIG. 12 to FIG. 16 above, main case 1400 is assembled first. As described above, main case 1400 includes main frame 1200, top plate 410 and bottom plate 430. Top plate 410, main frame 1200, and bottom plate 430 are arranged so that screw holes 401-404, 1201-1204, and 431-434 are lined up. First bottom plate 430 is secured to main frame 1200 via screw holes 431-434 by first set of screws 1101. Bottom plate 430 and central opening 205 form a space for storing multiple credit card holder 121. Slide controller bar 1320 and spacer 1310 are laid into slide slot 1222. Then, actuator 1212 is also placed right at the foot of slide controller bar 1230. Lever arm 1250 is fastened to main case 1400 via pivot 1254 wound by torsion spring 1255. Spring 605 is connected to lever arm 606 and to bottom fringe 207 by spring pivot 604. Then top plate 410 is secured to main frame 1200 at screw holes 1201-1204 using first set of screws 1101. Protective sheet 801 is adhered to slide cover 501 at central area 502. Side protective sheet 1001 is adhered to lateral side 503. Insertion metal 504 is inserted to insertion slot 411. At this moment, serrated section 505 is directly contacted with array of ball lock pins 1323. Decelerator button 1208-1 is adjusted to control the ejection speed of credit cards 121.

Figure 18:
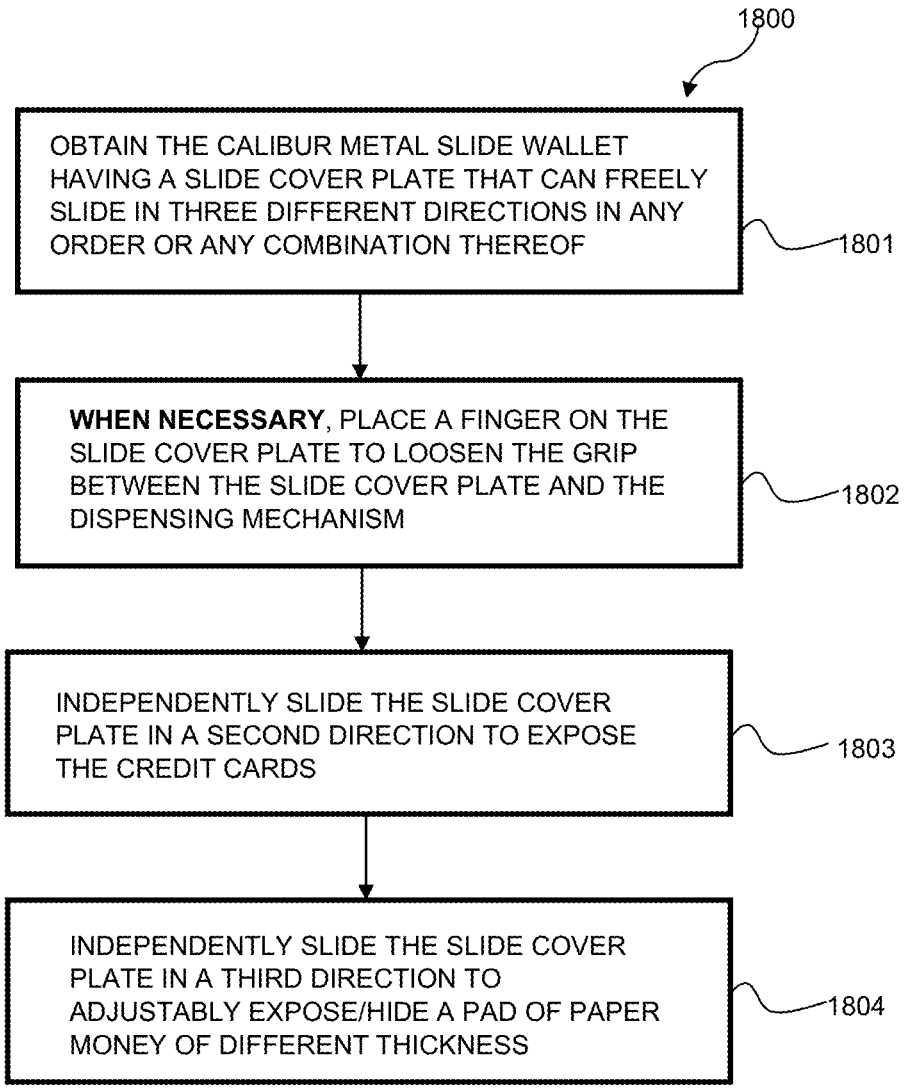
FIG. 18 is a flow chart of the method of using the metal slide wallet in accordance with an exemplary aspect of the present invention.

Finally, referring to FIG. 18, a method 1200 of use of metal slide wallet in accordance with an exemplary aspect of the present invention is illustrated.

At step 1801, metal slide wallets as disclosed in FIG. 1 to FIG. 17 are obtained. In various embodiments of the present invention, main case 1400 and second dispensing mechanism as described in FIG. 12-FIG. 17 are used. Second dispensing mechanism DS2 includes slide controller bar 1320, actuator 1240, and lever arm 1250. Some other embodiments of the present invention, main case 200 and first dispensing mechanism 600 are used as described in FIG. 2 to FIG. 11. Plastic cards such as credit cards, ID card, driver license are inserted into multiple credit card holder 121. Paper money is stored in the space between opening 205 and slide cover 111. In various preferred embodiment, second dispensing mechanism DS2 is used with wallet frame 1200.

At step 1802, the grip between the slide cover plate and the dispensing mechanism is loosen. Step 1802 is optional and realized by placing a finger on slide cover 111 and push it toward main case 1400 against side 209. This is step 1 described above. For first dispensing mechanism 600, step 1 will loosen slide cover 111, separating first serrated section 325 and second serrated section 505. For second dispensing mechanism DS2, step 1 describes that thumb 901 presses against lateral side 503 of slide cover 111 with a force $F_Y$ in the Y-direction to engage serrated section 505 to array of ball lock pins 1323. At the same time, array of ball lock pins 1323 is pushed in the Y-direction, decreasing the friction between lateral side 503 and spacer 1310. It is noted again that step 1802 (step 1) is optional or only necessary when the user wants to loosen the grip between dispensing mechanisms 600 and DS2, lateral side 503, and spacers 420 and 1310. In other words, the user can perform step 1803 (step 2) and step 1804 (step 3) without going through step 1802.

Now at step 1803, independently slide the slide cover plate in a second direction to expose the credit cards. To use the credit cards, slide cover 111 down is pulled down in a second direction perpendicular to the first direction. This is step 2 disclosed above. Lever arm 606 pushes up multiple credit cards 121. More particularly, thumb 901 slides down slide cover 111 in the Z-direction with a force $F_Z$ as described in FIG. 7 to eject multiple credit card holder 121 from main case 110. After use, as thumb 901 releases slide cover 810, spring 605 pulls lever arm 606 back to its initial position. The user can insert credit cards back to central opening 205 one by one. For second dispensing mechanism DS2, step 1802 is realized by step 2 described in FIG. 16 above. At step 2, thumb 901 slides down slide cover 111 in the X-direction with a force $F_X$ to eject multiple credit card holder 121 from main case 1210. Decelerator button 1208-1 controls the ejection of credit cards 121. After use, lever arm 1250 automatically returns to its initial position just like a clothespin due to torsion spring 1255. When this happens, foot 1243 is pushed upward, which, in turn, pushing upper portion 1321 upward to its original position at stop spur 1214.

Finally at step 1804, to retrieve paper money, place a finger on the lateral section 503 and push up/down slide cover 111 to expose or hide the paper money area 122. This is step 3 described above. For second dispensing mechanism DS2, step 1803 is realized by step 3 described in FIG. 16 above. Thumb 901 push slide cover 111 with a force $F_Z$ in the Z-direction to expose the paper money container 121. In another aspect of the present invention, step 1804, step 1803, and step 1802 can be performed in that order. Yet in another aspect of the present invention, the user may perform step 1802 to loosen the grip and then execute step 1804. It is noted that step 1802 to step 1804 can be performed independently in any order or in any combinations thereof.

As seen above from FIG. 1 to FIG. 18, metal slide wallet 100 of the present invention achieve the following objectives:

(a) easy to operate: slide cover plate is smoothly and continuously slid in three easy sliding movements;
(b) protective of both paper money and credit cards against the elements;
(c) shielding off RFID, NFC, and other electromagnetic signals; and
(d) slide cover plate 111 can be independently operated in with forces $F_X$, $F_Y$, and $F_Z$ three respective different directions X, Y and Z in any order and in any combinations thereof. In addition, slide cover plate 111 automatically returns to its initial position after each step 1802-1804.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The foregoing description details certain embodiments of the invention. It will be appreciated by a person of ordinary skills in the art that connections between various components described herewith may be by any suitable means such as nails, screws, bolts, connectors, pins, staples, dowels and the like. It also will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

DESCRIPTION OF NUMERALS

100 Calibur™ metal slide wallet
101 top side
102 bottom side
103 left side
104 right side
105 top surface
106 bottom surface
110 main case
111 slide cover (plate)
121 multiple credit card holder
122 paper money area (or tray)
199 Cartesian coordinate system
200 wallet frame
201 top left screw hole
202 top right screw hole
203 bottom left screw hole
204 bottom right screw hole
205 opening space
206-1 top cephalic border
206-2 bottom cephalic border
207 caudal border
208 left lateral side
208-1 decelerator button
208-2 decelerator housing
208-3 adjustable screw
209 right lateral side
211 top stopper edge
212 bottom stopper edge
213 lateral ditch
221 left slide slot
222 right slide slot
223 lever window
300 slide guide of type 1
310 top slide guide
311 first header
312 second header
320 bottom slide guide
323 first smooth section
324 second smooth section
325 serrated section
400 main case
401 first screw hole of the top cover plate
402 second screw hole of the top cover plate
403 third screw hole of the top cover plate
404 fourth screw hole of the top cover plate
411 slider insertion slot
420 spacer
430 bottom cover plate
431 first screw hole of the bottom cover plate
432 second screw hole of the bottom cover plate
433 third screw hole of the bottom cover plate
434 fourth screw hole of the bottom cover plate
501 rim of the slide cover
502 central area of the slide cover
503 lateral side of slide cover
504 insertion tab
600 first dispensing mechanism
601 actuator
602 lever arm pin
603 wheel
604 spring pivot
605 spring
606 graded lever arm
801 slide cover protector sheet
1001 side protective sheet
1101 first set of screws
1102 second set of screws
1200 wallet frame adapted to use second dispensing mechanism
1201 screw hole
1202 screw hole
1203 screw hole
1204 screw hole
1205 opening space
1206-1 top cephalic border
1206-2 bottom cephalic border
1207 caudal border
1208 left lateral side
1208-1 decelerator button
1208-2 decelerator housing
1208-3 adjustable screw
1209 right lateral side
1211 top stopper edge
1212 bottom stopper edge
1213 lateral shallow ditch
1221 left slot
1222 right slot
1223 lever window
1240 actuator
1241 top portion
1242 groove
1243 foot portion
1250 lever arm
1251 tail segment
1252 body segment
1253 graded segment
1254 pivot
1255 torsion spring
1310 spacer
1320 slide controller bar
1321 upper portion
1232 lower portion
1323 array of ball lock pins
1324 cut
1330 slide controller bar
1331 upper portion
1332 lower portion
1333 serrated section
1400 main case
DS2 second dispensing mechanism

What is claimed is:

1. A wallet, comprising:

a hollow cuboid frame having a length, a width, and a height for storing a plurality of plastic cards; wherein said frame further comprises lateral slots formed along the length of said frame, and a top side opening formed along the width of said frame;

a dispensing mechanism comprising a slide controller bar disposed along said lateral slots, an actuator disposed beneath said slide controller bar, a locking means, and a lever arm; and a slide cover plate, slidably coupled to said frame and said dispensing mechanism, operative to independently (a) press in a first direction to cause said locking means to loosen said slide cover plate from an engaging position; (b) to slide in a second direction to cause said actuator to actuate said lever arm to eject said plurality of plastic cards in a direction opposite to said second direction out of said top side opening, and (c) slide said slide cover plate in a third direction to cause said locking means to expose paper money.

2. The wallet of claim 1, wherein said lateral slots further comprise:

a left side slot formed along the length of said frame; and a right side slot formed on opposite side of said left side slot.

3. The wallet of claim 2:

wherein said top side opening is formed by a space between a first top border and a second top border formed on a plane beneath and parallel to said first top border; and wherein said top side opening is connected to said hollow space so that said plurality of plastic cards capable of sliding in and out of said frame.

4. The wallet of claim 3 wherein said slide controller bar further comprises a serrated section adapted to couple to said slide cover plate and a cut adapted to couple to said frame.

5. The wallet of claim 3 wherein said slide controller bar further comprises an array of ball lock pins and a cut adapted to couple to said frame.

6. The wallet of claim 5 further comprising a top cover lid having an insertion slot formed along the length of said frame and substantially near the right hand side edge of said top cover lid.

7. The wallet of claim 6 wherein said slide cover plate further comprises a top surface, a lateral surface, and an insertion bar; wherein said slide cover plate is inserted into said frame using said insertion bar to insert into said insertion slot; and wherein said lateral surface and said insertion bar are protruding from an edge of said top surface.

8. The wallet of claim 7 further comprising a multiple credit card holder adapted to hold said plurality of credit cards, and wherein said multiple credit card holder is directly contacted to be lifted up or lowered by said lever arm as said slide cover plate is actuated by a user.

9. The wallet of claim 8 wherein said lever arm further comprises a plurality of step levels each corresponding to a level of exposure of said multiple credit card holder.

10. The wallet of claim 9 wherein said lever arm further comprises a pivot adapted to secure said lever arm to said frame and a torsion spring coupled to said pivot.

11. The wallet of claim 10 wherein said said left side slot further comprises a decelerator including a housing, a button, and a screw; wherein said screw is coupled to control a sliding of said credit card holder.

12. The wallet of claim 11 wherein said actuator further comprises a top portion and a bottom portion; wherein when said slide cover plate is slid in said second direction, said top portion is pushed down by said slide controller bar which causes said foot portion contacts to raise said lever arm.

13. The wallet of claim 12 wherein said frame is made of an RFID protective material.

14. A method of making a RFID protective wallet, comprising:

provide a cuboid frame having a top side opening, lateral slots, and an internal hollow space for storing credit cards and paper money;

provide a dispensing mechanism comprising a slide controller bar, an actuator disposed beneath said slide controller bar, and a lever arm in one of said lateral slots; and slidably couple a slide cover plate to said frame using said dispensing mechanism so that said slide cover plate is operative to independently (a) press in a first direction to cause said locking means to loosen said slide cover plate from an engaging position; (b) to slide in a second direction to cause said actuator to actuate said lever arm to expose said credit cards out of said top side opening, and (c) slide said slide cover plate in a third direction to cause said locking means to expose paper money.

15. The method of claim 14 wherein said top side opening is formed by a space between a first top border and a second top border formed on a plane beneath and parallel to said first top border; and wherein said top side opening is connected to said hollow space so that said credit cards capable of sliding in and out of said frame.

16. The method of claim 15 further comprising:

providing a credit card holder for containing said credit cards;

and providing a rough protective sheet on top of said slide cover plate.

17. The method of claim 16 further comprising:

providing a top plate having an insertion slot imprinted on a right side substantially near an edge of said top plate, wherein said slide cover plate is coupled to said dispensing mechanism via said insertion slot; and providing a bottom plate secured to a bottom side of said cuboid frame.

18. The method of claim 17 further comprising a decelerator including a housing, a button, and a screw; wherein said screw is coupled to control a sliding rate of said credit card holder.

19. The method of claim 18 further comprising forming a cut on said slide controller bar.

20. The method of claim 19 further comprising forming a spur inside said right side slot of said cuboid frame at a location that allows said cut to mate with said spur.

* * * * *